US008836453B2

(12) United States Patent
Yang et al.

(10) Patent No.: US 8,836,453 B2
(45) Date of Patent: Sep. 16, 2014

(54) ELECTRONIC CIRCUIT BREAKER, ELECTRONIC CIRCUIT BREAKER SUBASSEMBLY, CIRCUIT BREAKER SECONDARY ELECTRICAL CONTACT ASSEMBLY, AND POWERING METHODS

(71) Applicants: Guang Yang, Suwanee, GA (US); Brian Timothy McCoy, Lawrenceville, GA (US)

(72) Inventors: Guang Yang, Suwanee, GA (US); Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 3 days.

(21) Appl. No.: 13/768,028

(22) Filed: Feb. 15, 2013

(65) Prior Publication Data

US 2013/0153375 A1 Jun. 20, 2013

Related U.S. Application Data

(63) Continuation-in-part of application No. 13/267,932, filed on Oct. 7, 2011, now Pat. No. 8,476,992.

(60) Provisional application No. 61/623,698, filed on Apr. 13, 2012.

(51) Int. Cl.

| | |
|---|---|
| ***H01H 75/00*** | (2006.01) |
| ***H01H 71/62*** | (2006.01) |
| ***H01H 9/20*** | (2006.01) |
| ***H01H 71/50*** | (2006.01) |
| ***H01H 71/46*** | (2006.01) |

(52) U.S. Cl.

CPC ..... *H01H 9/20* (2013.01); *H01H 71/62* (2013.01); *H01H 71/505* (2013.01); *H01H 71/46* (2013.01)

USPC ..... 335/6; 335/167

(58) Field of Classification Search

USPC ..... 335/6

See application file for complete search history.

(56) References Cited

U.S. PATENT DOCUMENTS

| | | | | | |
|---|---|---|---|---|---|
| 2,360,682 | A | * | 10/1944 | Hutt | 337/52 |
| 2,844,689 | A | * | 7/1958 | Middendorf | 337/110 |
| 3,213,249 | A | * | 10/1965 | Ellsworth et al. | 337/52 |
| 3,278,707 | A | * | 10/1966 | Klein | 337/70 |
| 3,594,668 | A | * | 7/1971 | Clarke et al. | 335/13 |
| 3,636,410 | A | * | 1/1972 | Pardini | 361/95 |
| 3,651,436 | A | * | 3/1972 | Cooper et al. | 335/13 |
| 3,786,382 | A | * | 1/1974 | Powell | 335/169 |
| 3,950,714 | A | * | 4/1976 | Mrenna et al. | 335/35 |
| 3,950,715 | A | * | 4/1976 | Bagalini et al. | 335/35 |
| 4,056,816 | A | * | 11/1977 | Guim | 340/638 |
| 4,081,852 | A | * | 3/1978 | Coley et al. | 361/45 |

(Continued)

FOREIGN PATENT DOCUMENTS

DE 19636109 C1 * 12/1997

*Primary Examiner* — Shawki S Ismail
*Assistant Examiner* — Lisa Homza

(57) ABSTRACT

Embodiments provide an electronic circuit breaker subassembly and circuit breaker secondary electrical contact assembly. The circuit breaker secondary electrical contact assembly has a main contact terminal connectable to a main power terminal, a secondary electrical contact set having a stationary secondary electrical contact and a moveable secondary electrical contact, a lockout conductor provided in spring-engaged contact with the main contact terminal on a first end and including one of the stationary or moving secondary electrical contacts on a second end, and a spring having the moveable secondary electrical contact provided on a moveable portion. Circuit breakers and methods of operating the electronic circuit breaker are provided, as are other aspects.

16 Claims, 21 Drawing Sheets

(56) References Cited

U.S. PATENT DOCUMENTS

| | | | | | |
|---|---|---|---|---|---|
| 4,156,219 | A | * | 5/1979 | Coleman | 335/175 |
| 4,231,006 | A | * | 10/1980 | Belttary | 335/36 |
| 4,276,457 | A | * | 6/1981 | Myers | 200/401 |
| 4,417,222 | A | * | 11/1983 | Schmitt et al. | 335/6 |
| 4,459,572 | A | * | 7/1984 | Fajner et al. | 335/16 |
| 4,464,641 | A | * | 8/1984 | Bellows | 335/23 |
| 4,468,645 | A | * | 8/1984 | Gerbert-Gaillard et al. | 335/42 |
| 4,616,198 | A | * | 10/1986 | Pardini | 335/16 |
| 4,617,540 | A | * | 10/1986 | Westermeyer | 335/35 |
| 4,677,406 | A | * | 6/1987 | Landron et al. | 335/35 |
| 4,922,220 | A | * | 5/1990 | Livesey et al. | 337/82 |
| 4,945,325 | A | * | 7/1990 | Toda et al. | 335/16 |
| 5,101,186 | A | * | 3/1992 | Durum | 337/76 |
| 5,285,180 | A | * | 2/1994 | Rezac et al. | 335/202 |
| 5,432,491 | A | * | 7/1995 | Peter et al. | 335/35 |
| 5,844,188 | A | * | 12/1998 | Cella et al. | 218/22 |
| 5,859,578 | A | * | 1/1999 | Arnold | 337/110 |
| 5,866,996 | A | * | 2/1999 | Navarre | 218/22 |
| 6,087,914 | A | * | 7/2000 | Kralik | 335/35 |
| 6,459,355 | B1 | * | 10/2002 | Furuhata et al. | 337/52 |
| 7,259,944 | B2 | * | 8/2007 | Branston et al. | 361/2 |
| 8,415,574 | B2 | * | 4/2013 | McCoy et al. | 200/43.14 |
| 2004/0099514 | A1 | * | 5/2004 | McCoy | 200/43.11 |

* cited by examiner

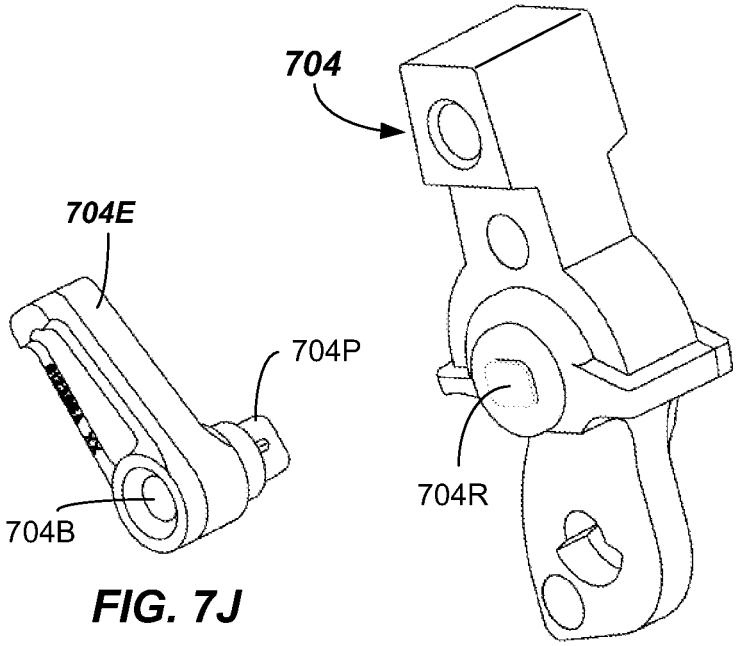
FIG. 7J
FIG. 7I
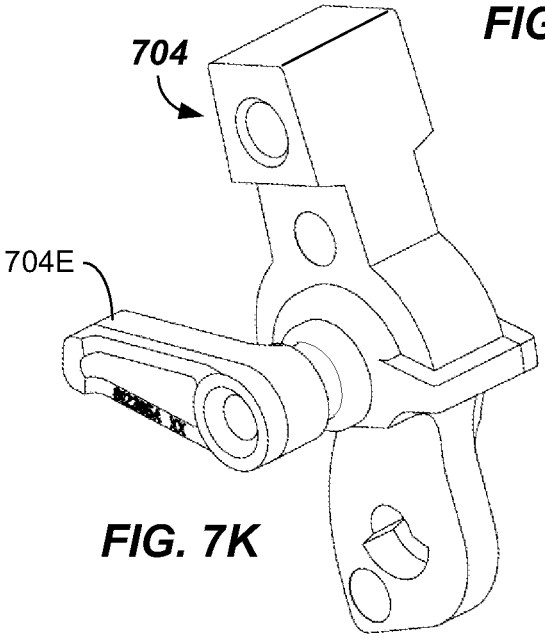
FIG. 7K

ELECTRONIC CIRCUIT BREAKER, ELECTRONIC CIRCUIT BREAKER SUBASSEMBLY, CIRCUIT BREAKER SECONDARY ELECTRICAL CONTACT ASSEMBLY, AND POWERING METHODS

RELATED APPLICATIONS

This application claims priority to U.S. Provisional Patent Application Ser. No. 61/623,698 filed on Apr. 13, 2012, entitled "Lockout Mechanism And Secondary Contact Mechanism For Lockout That Allow Compact Packaging," and is a continuation-in-part application of U.S. patent application Ser. No. 13/267,932 filed on Oct. 7, 2011, entitled "CIRCUIT BREAKER HAVING AN UNLOCKING MECHANISM AND METHODS OF OPERATING SAME," the disclosures of each of which are hereby incorporated by reference in their entirety herein.

FIELD

The present invention relates generally to a circuit breaker for interrupting current from an electrical power supply, and, more particularly, to a circuit breakers having unlocking mechanisms.

BACKGROUND

Circuit breakers are used in certain electrical systems for protecting an electrical circuit coupled to an electrical power supply. For example, electronic circuit breakers, such as Arc Fault Circuit Breakers (AFCIs), Ground Fault Circuit Interrupters (GFCIs), Transient Voltage Surge Suppressors (TVSSs), and surge protectors use electronic components to detect certain types of faults, such as arc faults or ground faults or other unwanted electrical conditions.

If one or more of the electronic components in such a circuit breaker fails, the electronic circuit breaker may be unable to electrically protect the one or more electrical branch circuits that are electrically connected thereto. Accordingly, electronic circuit breakers having an ability to self-check prior to closing the main contacts are desired.

SUMMARY

In a first aspect, an electronic circuit breaker subassembly is provided. The electronic circuit breaker subassembly includes a housing, a main contact terminal connectable to a main power terminal, a secondary electrical contact set having a stationary secondary electrical contact and a moveable secondary electrical contact, a lockout conductor provided in spring-engaged contact with the main contact terminal on a first end and including one of the stationary or moving secondary electrical contacts on a second end, a spring having the moveable secondary electrical contact provided on a moveable portion, and a handle moveable between at least an ON configuration and an OFF configuration, the handle configured and operable to cause motion of the moveable portion and cause engagement of the moveable secondary electrical contact and stationary secondary electrical contact.

In another aspect, a circuit breaker secondary electrical contact assembly is provided. The electronic circuit breaker secondary electrical contact assembly includes a main contact terminal connectable to a main power terminal, a secondary electrical contact set having a stationary secondary electrical contact and a moveable secondary electrical contact, a lockout conductor provided in spring-engaged contact with the main contact terminal on a first end and including one of the stationary or moving secondary electrical contacts on a second end, and a spring having the moveable secondary electrical contact provided on a moveable portion.

According to another aspect, a method of powering a printed circuit board of a circuit electronic circuit breaker is provided. The method includes providing a main contact terminal coupled to a main power terminal, providing a secondary electrical contact set having a stationary secondary electrical contact and a moveable secondary electrical contact, the moveable secondary electrical contact being coupled to a spring, electrically connecting a lockout conductor in spring-engaged contact with the main contact terminal on a first end and to one of the stationary secondary electrical contact or moving secondary electrical contact on a second end, and receiving power at a printed circuit board by contacting the spring with a handle extension to close the secondary electrical contact set.

In another aspect, an electronic circuit breaker is provided. The electronic circuit breaker includes a moveable contact arm, and a lockout mechanism operable to block motion of the moveable contact arm. The lockout mechanism has a lockout latch operatively pivotal about a pivot axis, a moveable stop adapted to contact the moveable contact arm, the moveable stop including an end latching surface having a non-90 degree angle configured to have a normal vector, and an engagement portion offset from the pivot axis, and an actuator operative to provide an unlock force at the engagement portion causing pivoting of the lockout latch about the pivot axis and release of the moveable contact arm wherein the end latching surface having a non-90 degree angle biases the lockout latch to a blocking condition.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the claimed invention.

BRIEF DESCRIPTION OF DRAWINGS

FIGS. 7I-7K illustrates isometric views of a handle and separate handle extension according to embodiments.

DETAILED DESCRIPTION

Figure 1A:
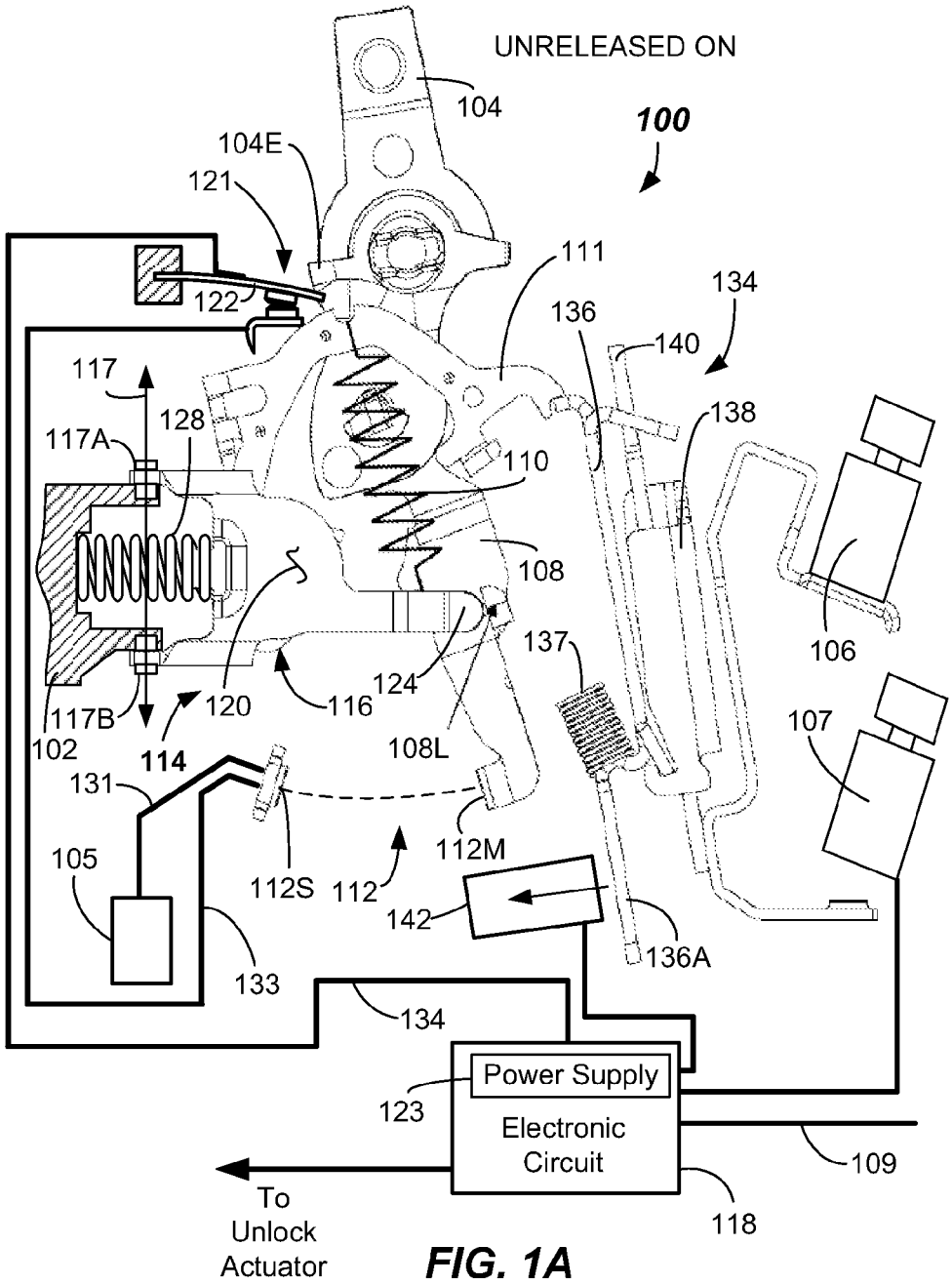
FIG. 1A illustrates a side view of several components of an embodiment of circuit breaker shown in an unreleased ON configuration.

In view of the foregoing difficulties, a circuit breaker is provided that has a unlocking mechanism with a moveable stop adapted to allow locking and unlocking of a moveable contact arm of the circuit breaker. In particular, the unlocking mechanism is locked as the handle is moved toward an ON configuration. The electronic circuit breaker includes main electrical contacts and a secondary electrical contact set. According to one aspect, closing of the secondary electrical contact set is accomplished in the ON configuration. Secondary electrical contact closing may be used to initiate powering of an internal electronic circuit (e.g., a printed circuit board (PCB) of the electronic circuit breaker. Once powered, a self test may be carried out on the internal electronic circuit of the circuit breaker in the locked state. If the self test is passed, then the moveable contact arm may be unlocked through disengaging the moveable stop of the unlocking mechanism from the moveable contact arm. This allows the moveable contact arm to move so that the main electrical contacts may be closed. In contrast, if the electronic circuit breaker is determined to have a failed internal electronic circuit and/or electronic component as a result of a failed self test, then the moveable contact arm and unlocking mechanism remain in a locked configuration.

According to one aspect, the electronic circuit breaker includes a lockout mechanism operable to cause contact with the moveable contact arm and block motion of the moveable main electrical contact. The lockout mechanism has a lockout latch having one or more pivot joints operatively pivotal about a pivot axis, a moveable stop, and an engagement portion offset from the pivot axis, wherein the moveable stop is adapted to contact the moveable contact arm. An unlock actuator is operative to provide an unlock force at the engagement portion causing pivoting of the lockout latch about the pivot axis and allowing release of the moveable contact arm.

In another broad aspect, an electronic circuit breaker is provided. The circuit breaker includes secondary electrical contacts configured to engage each other when a handle of the circuit breaker is in the ON configuration, and a leaf spring operably supporting a moveable one of the secondary electrical contacts, wherein the leaf spring is configured to be flexed to close the secondary electrical contacts in the ON configuration.

In yet another broad aspect, an electronic circuit breaker subassembly is provided. The electronic circuit breaker subassembly includes a housing, a main contact terminal connectable to a main power terminal, a secondary electrical contact set having stationary and moveable secondary electrical contacts, a lockout conductor provided in spring-engaged contact with the main contact terminal on a first end and including the stationary or moving secondary electrical contact on a second end, a spring having the moveable secondary electrical contact on a moveable portion; and a handle moveable between at least an ON configuration and an OFF configuration, the handle configured and operable to cause motion of the moveable portion and cause engagement of the moveable secondary electrical contact and stationary secondary electrical contact. Circuit breaker secondary electrical contact assemblies and methods of powering internal electronic circuit (e.g., a printed circuit board (PCB) of the electronic circuit breaker are provided.

Advantageously, embodiments of the present invention enable the ability to immediately provide power to the electronic circuit of the circuit breaker when the circuit breaker is in the ON configuration (both unreleased and released ON configurations). Furthermore, embodiments of the present invention simplify the construction of the mechanisms by eliminating the need to reopen the secondary contacts as the circuit breaker handle is moved from an OVER ON configuration to the ON configuration, as was required in US Pub. No. 2009/0189719 entitled "Circuit Breaker Locking and Unlocking Mechanism," the disclosure of which is hereby incorporated by reference in its entirety herein.

The present invention is not limited to the illustrative examples for single-pole electronic circuit breakers described herein, but is equally applicable to other types of electronic circuit breakers. For example, this aspect of present invention may be useful with other circuit breakers, such as two-pole electronic circuit breakers, surge protective devices such as transient voltage surge protection (TVSS) devices, metering circuit breakers, electronic trip unit circuit breakers, and remotely controllable circuit breakers, for example. Other types of circuit breakers including single or multiple electrical branches may benefit as well.

These and other embodiments of electronic circuit breakers, subassemblies, secondary electrical contact assemblies, methods of powering internal electrical circuits, and methods of operating the electronic circuit breaker and powering printed circuit boards are described below with reference to FIGS. 1A-9. The drawings are not necessarily drawn to scale. Like numerals are used throughout the specification to denote like elements.

Figure 1B:
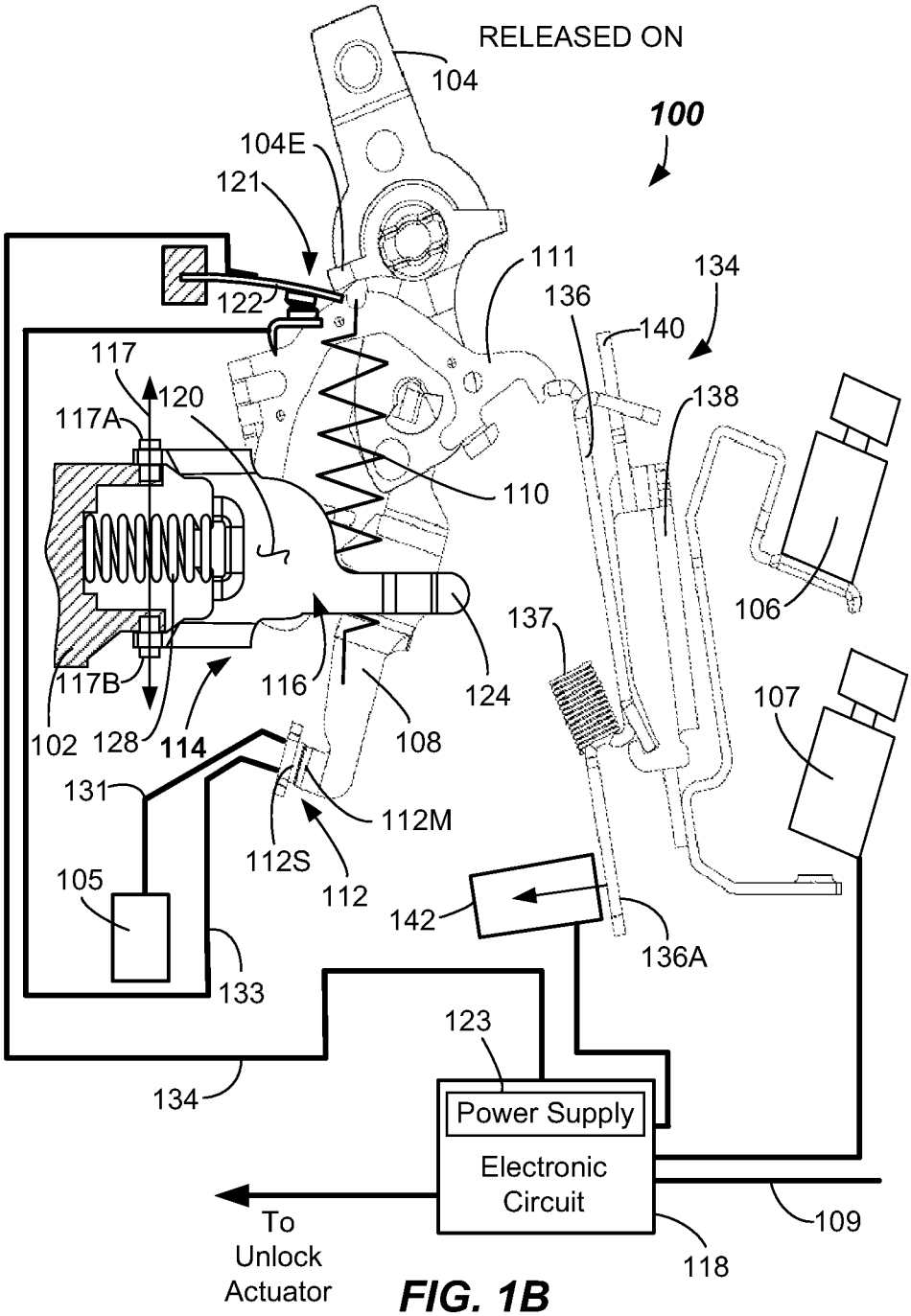
FIG. 1B illustrates a side view of a circuit breaker shown in a released ON configuration with both the main electrical contacts being closed.

Referring now in specific detail to FIGS. 1A-1B, an electronic circuit breaker 100 is shown. Some portions of the housing are not shown to aid in understanding of the novel and unobvious features of the invention. The electronic circuit breaker 100 will be referred to herein as "electronic circuit breaker" or just "circuit breaker." The electronic circuit breaker 100 includes a housing 102, which may be formed from several molded housing portions. In the depicted embodiment of a single-pole circuit breaker, left and right housing portions may interconnect with each other via multiple fasteners (e.g., rivets) to form the housing 102 and internal spaces and surfaces to contain, mount, and retain the other circuit breaker components. The housing 102 may be made from any suitable rigid plastic, such as thermoset plastic material (e.g., polyester). Other materials may be used. Furthermore, other means of fastening the portions together may be used, such as screws, plastic welding, or adhesive. Furthermore, a higher number of housing portions may be used to form the housing 102. For example, in a two-pole electronic circuit breaker, two mechanical poles are provided in first and second housing portions, and the internal electronic circuit may be housed in a third center housing section.

The electronic circuit breaker 100 includes a handle 104 adapted to switch the various breaker components between at least ON and OFF configurations, with the unreleased ON configuration being shown in FIG. 1A, and the released ON configuration be shown in FIG. 1B. The circuit breaker may also be configured in a TRIP and RESET configuration (not shown). The handle 104 may be used to manually switch the electronic circuit breaker 100 from the OFF configuration to the unreleased ON configuration. Further, the handle 104 may reset the electronic circuit breaker 100 from a TRIP configuration (not shown). Handle 104 may also be manufactured (e.g., molded) from a suitable polymer material (e.g. a thermoplastic).

In the depicted embodiment, a power terminal 105 is provided, that may be configured to couple to a conventional stab, for example. The power terminal 105 may have a U-shaped form and may couple to a stab provided at a single standard circuit breaker location in a load center. Optionally, a standard assembly including a lug and lug screw may be employed. The term "load center" as used herein refers to any component that includes the ability to distribute electrical power to multiple electrical branch circuits, and which is adapted to receive and mount one or more circuit breakers to protect those electrical branch circuits.

A load terminal 106 is also provided and is adapted to be operationally connected to an electrical branch/electrical load (not shown). A load neutral terminal 107 may be provided and may be connected to a load neutral of the protected electrical circuit branch. The electronic circuit breaker 100 may also include neutral pigtail 109 adapted to be secured to a load center neutral (e.g., neutral bar), for example. The handle 104 may operationally interface with a moveable contact arm 108 through a conventional pivot and move the contact arm 108 from an OFF configuration (not shown) to an unreleased ON configuration shown in FIG. 1A. Spring 110 is coupled between the arm 108 and a cradle 111 and provides the spring force to keep the circuit breaker 100 in the selected configuration (released ON, OFF, TRIP). The spring 110 and cradle 111 are of conventional construction.

Main electrical contacts 112, including a moveable main electrical contact 112M and a stationary main contact 112S, engage and disengage each other depending upon the configuration of the circuit breaker 100 (e.g., unreleased ON, released ON, OFF, TRIP) thereby making the main electrical contacts 112 configurable between an opened and closed condition. In the unreleased ON configuration shown in FIG. 1A, the main electrical contacts 112 are separated from each other thereby opening any attached protected electrical circuit branch. In the depicted embodiment of electronic circuit breaker 100 shown, secondary electrical contacts 121 are also provided. The secondary electrical contacts 121 include a stationary secondary electrical contact 121S and a moveable secondary electrical contact 121M. In the OFF configuration, the secondary electrical contacts 121 are opened (not engaged), and, thus, no power is provided to the internal electronic circuit 118 of the electronic circuit breaker 100. However, as the handle 104 is moved to the unreleased ON configuration shown in FIG. 1A, the handle 104 contacts and flexes a leaf spring 122 to cause electrical contact between the secondary contacts 121. The present invention circuit breaker 100 also includes a power supply 123 adapted to supply electrical power to the internal electronic circuit 118 and other electrical components of the electronic circuit breaker 100.

The circuit breaker 100 includes an unlock mechanism 114 operable to cause contact with the moveable contact arm 108 and block motion of the moveable main electrical contact 112M. The unlock mechanism 114 has a lockout latch 116 having one or more pivot joints 117A, 117B operatively pivotal about a pivot axis 117 on a first end, a moveable stop 124 on a second end, a bias spring 128, and an engagement portion 120 offset from the pivot axis 117 along a length of the lockout latch 116, the moveable stop 124 being adapted to contact the moveable contact arm 108 (See FIG. 1A). The lockout latch 116 includes a first leg and a second leg, each of the first and second legs include a pivot joint, wherein the engagement portion 120 is positioned between the moveable stop 124 and the first and second legs. The first leg and a second leg may each be coupled to a respective pin forming the pivot joints 117A, 117B, where the pins are received through a hole in each of the legs, and are fixed in the portions of the housing 102. Each of the first leg and the second leg may include parallel mounting faces at the pivot joints 117A, 117B.

Figure 2:
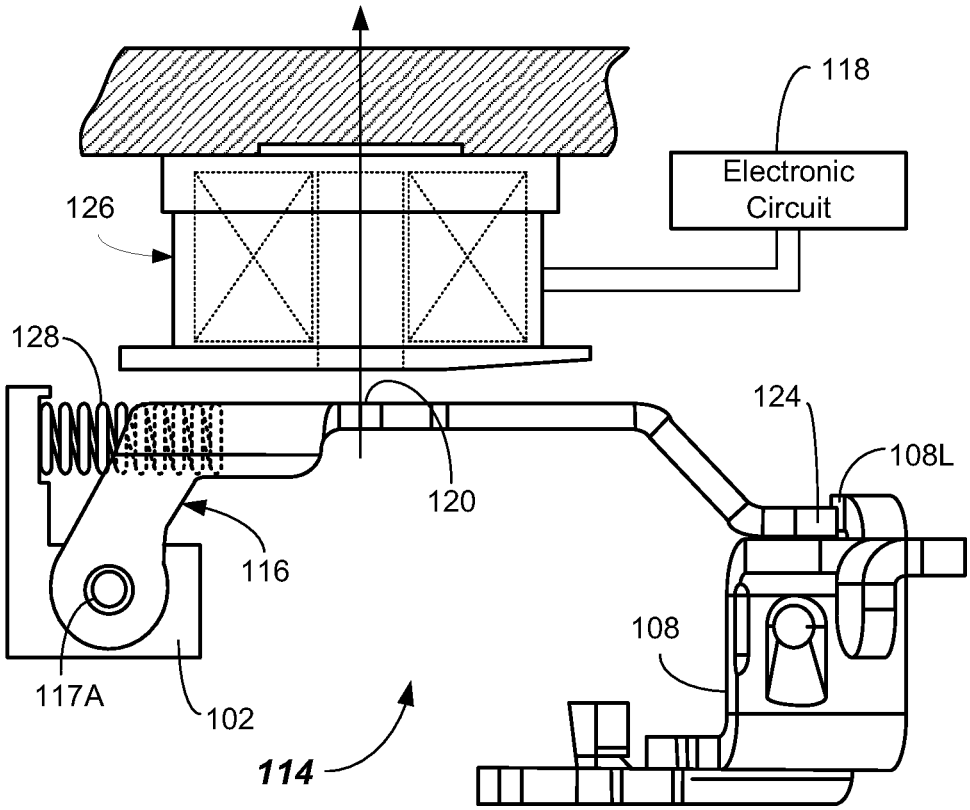
FIG. 2 illustrates a top view of an embodiment of lockout assembly for a circuit breaker shown in a locked configuration.
Figure 3:
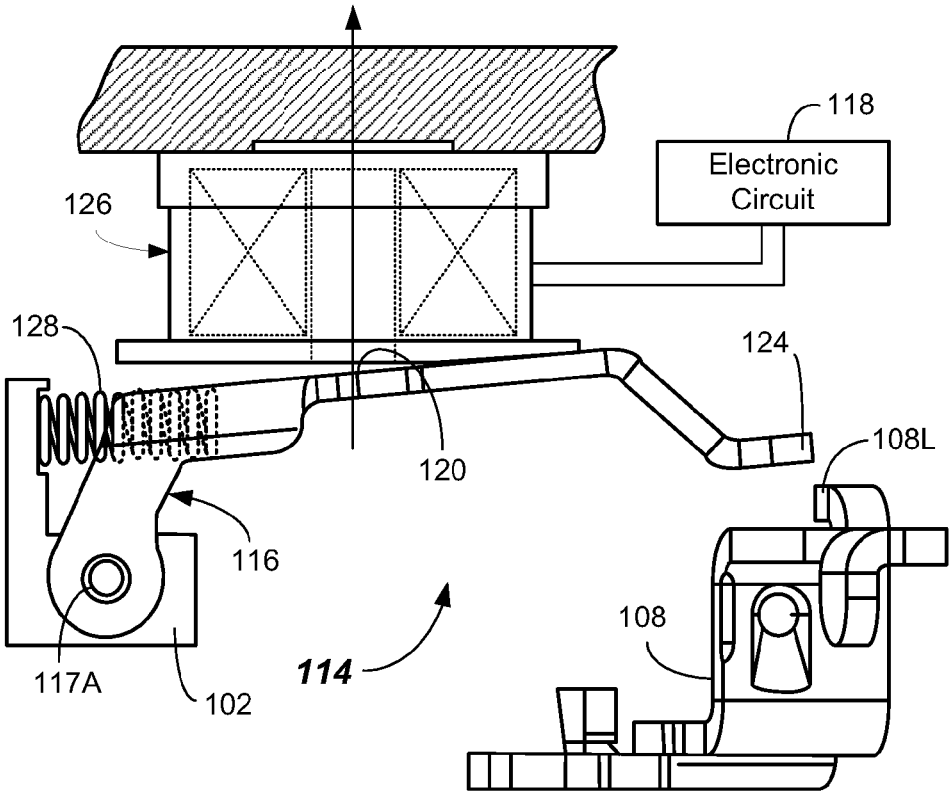
FIG. 3 illustrates a top view of a lockout assembly in an unlocked configuration allowing a moveable contact arm to continue to a released ON configuration thereby closing the main electrical contacts.

As shown in FIGS. 2 and 3, the unlock mechanism 114 also includes an unlock actuator 126 operative to provide an unlock force at the engagement portion 120. The unlock force may be a magnetic attraction force on the lockout latch 116 causing pivoting of the lockout latch 116 about the pivot axis 117 as shown in FIG. 3. This pivotal motion releases the moveable contact arm 108 as shown in FIG. 1B thereby allowing the stationary main contact 112S and moveable main contact 112M to close. The unlock actuator 126 may be any suitable actuator, such as an electromagnet or solenoid. The solenoid shown in FIGS. 2 and 3 includes a core surrounded by coil windings. The lockout latch 116 may be ferromagnetic (e.g., steel) or include a ferromagnetic portion at the engagement portion 120.

In the depicted embodiment, the movable contact arm 108 may include an extension member 108L that is adapted to interact with the moveable stop 124 so as to lock (e.g., block) the contact arm 108 from continued motion at certain times during the operation of the circuit breaker 100. The extension member 108L may be formed as a tab extending from a body of the moveable contact arm 108, for example. However, any suitable structure for the extension member 108L that may be contacted by a moveable stop 124 may be used. For example, in an alternative embodiment, the body of the contact arm 108 may be contacted directly. Other suitable constructions of the locking and unlocking mechanism may be used, such as is described in US Pub. No. 2009/0189719.

Again referring to FIG. 2, as the handle 104 is moved towards the ON configuration from the OFF configuration, the moveable stop 124 is configured, positioned, and operable to contact and engage the extension member 108L. The moveable stop 124 is normally positioned in a blocking orientation via the spring force exerted by the bias spring 128. The normal motion path of the contact arm 108 as the handle 104 moves towards the ON configuration causes contact between the extension member 108L and the moveable stop 124 and blocks and locks the contact arm 108 in a fixed, opened position as shown in FIG. 2. This locking action maintains separation of the main electrical contacts 112 initially in the unreleased ON configuration.

The moveable stop 124 is operable to disengage the contact arm 108 responsive to a signal provided from the electronic circuit 118 to allow closing of the main electrical contacts 112 (see FIG. 1B). For example, the closing of the main contacts 112 may be predicated upon successful completion of a self test of the electronic circuit 118 and/or connected circuit breaker electrical components.

Figure 4A:
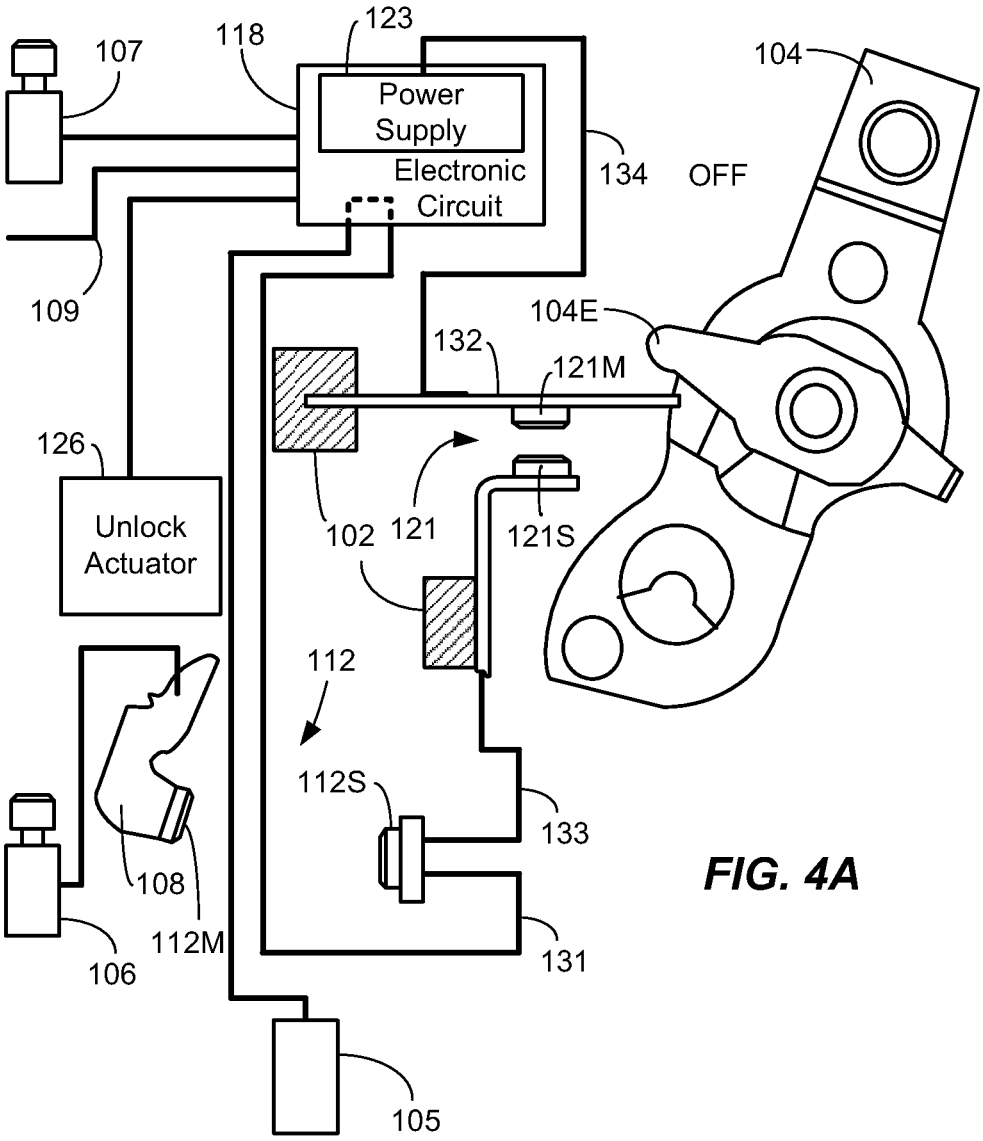
FIG. 4A illustrates a side view of several components of a circuit breaker shown in an OFF configuration with both the main and secondary electrical contacts being open.
Figure 4B:
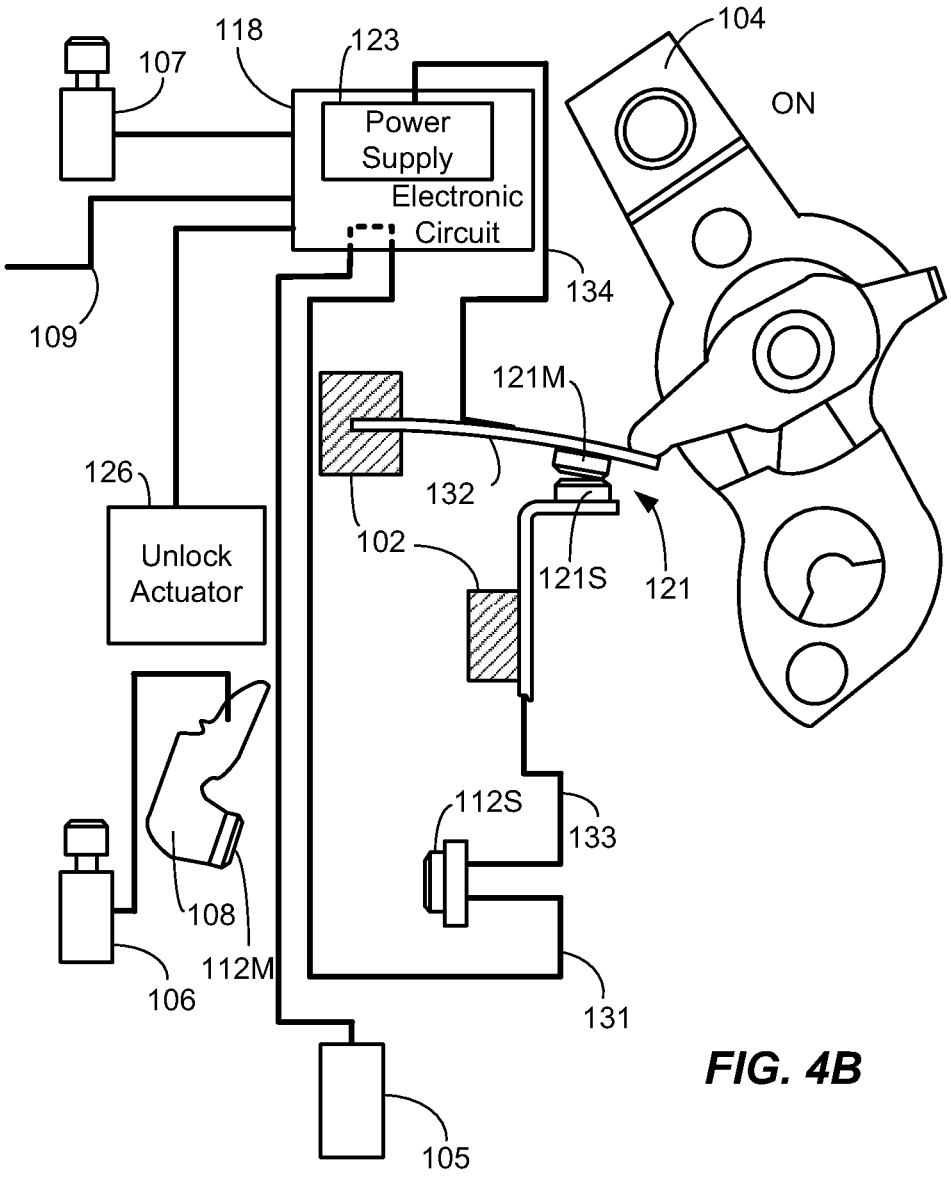
FIG. 4B illustrates a side view of several components of a circuit breaker in an unreleased ON configuration with the main electrical contacts being open and secondary electrical contacts being closed.
Figure 4C:
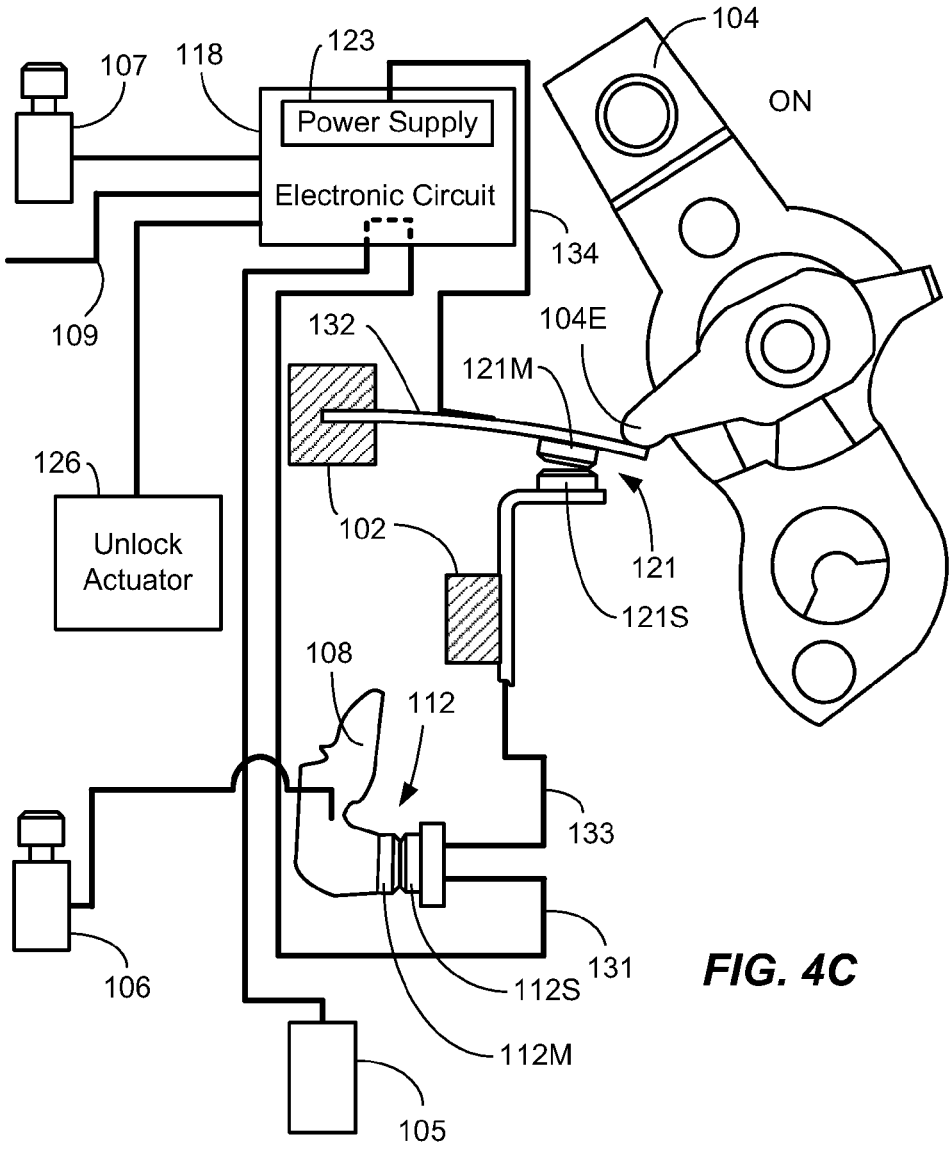
FIG. 4C illustrates a side view of several components of a circuit breaker in a released ON configuration with both the secondary and main electrical contacts being closed following a passed self test.

According to another aspect, it should be recognized that secondary electrical contacts 121, as shown in FIGS. 4A-4C, may come into contact with each other only in the ON configuration (both the unreleased ON (FIG. 1A) and the released ON (FIG. 1B) configurations). Moreover, once in the released ON configuration, the secondary electrical contacts 121 may continue to be engaged in electrical contact via the force provided by the main spring 110 (FIG. 1B). In some embodiments, the secondary electrical contacts 121 only engage each other during the ON configurations (both unreleased and released ON) and are disengaged from each other while in other configurations (OFF, TRIP, and RESET).

When in the unreleased ON configuration (FIG. 1A), in some embodiments, a self test may be initiated responsive to power being provided to the internal electronic circuit 118 by a suitable power supply 123. For example, the self test may be as described in U.S. Pat. No. 7,936,543, the disclosure of which is hereby incorporated by reference herein. Other suitable self testing of the health of the electrical circuit 118, one or more circuit breaker electronic components connected to the electrical circuit 118, or the fault detection sub-circuit(s) of the electrical circuit 118 may be performed.

As shown in FIGS. 1A-1B and 4A-4C, closing the secondary electrical contacts 121 supplies current from the power terminal 105, through conductors 131 and 133 connected to the stationary main contact 112*s*, and conductor 134 to the power supply 123. Conductor 131 may pass through a component of the electronic circuit 118 (e.g., a sensor such as a differential current transformer), for example. The dotted line on the electronic circuit 118 is meant to indicate that the conductor 131 may pass through such a sensor. Optionally, the conductor 131 may extend directly to the stationary main contact 112S.

As shown in FIGS. 4A-4C, closing of the secondary electrical contacts 121 may be accomplished by an extension portion 104E of the handle 104 contacting a leaf spring 132 coupled to the moveable electrical contact 121M. This contact operates against a spring force provided by leaf spring 132 that normally keeps the contacts 116S and 116M in an opened, non-contacting condition. Upon supplying power to the power supply 123 and the internal electronic circuit 118 by closing the secondary electrical contacts 121, an automatic self test routine may be initiated. The self test may automatically initiate a testing sequence that functions to test the operability and ability of the electronic circuit 118 and/or circuit breaker components connected to the electronic circuit 118 (e.g., sensor and/or actuators) to detect faults (e.g., arc faults, ground faults, or the like).

If established test criteria is met during the self test (e.g., test passed), then a signal may be sent from the electronic circuit 118 to the unlock actuator 126 to pivot the unlock latch 116, as shown in FIG. 3, thereby moving the moveable stop 124 from the lock member 108L and unlocking and releasing the moveable contact arm 108. The unlock actuator 126 may operate against the bias force provided by the bias spring 128, whereas the bias spring 128 normally provides the moveable stop 124 in a blocking positional orientation. If the self test is failed, thereby indicating a failed electrical component and/or electronic circuit 118, then no signal may be provided. Accordingly, when a self test failure is detected, the moveable stop 124 continues to block/lock the moveable contact arm 108. After a failed self test and locking of the moveable contact arm 108, when the user releases the handle 104, the handle 104 and other circuit breaker components will return to the OFF configuration. Accordingly, this indicates that all power is turned off to the protected electrical circuit branch after the self test failure. Advantageously, the present invention provides the ability to provide a fail-safe feature to the circuit breaker 100 such that the main electrical contacts 112 cannot be closed until a suitable self test of the electronic circuit 118 and/or electrical components is passed. The unlock mechanism 114 provides a compact and efficient means to unlock the contact arm 108.

Optionally, the electronic circuit breaker 100 may include a push-to-test button (not shown) to initiate a self test once the electronic circuit 118 is energized in the unreleased ON configuration (FIG. 1A). Once the self test is passed, then the electronic circuit 118 may send a signal to the unlock actuator 126 to release the moveable contact arm 108 (FIGS. 1B and 3) and allow the main electrical contacts 112 to close. Furthermore, the electronic circuit breaker 100 may include one or more status indicators, such as LEDs (not shown), to indicate the existence of a failed electronic circuit 118 if the self test is failed, or otherwise indicate a detected fault condition when the circuit breaker 100 is in operation and coupled to a protected electrical circuit branch.

Once the self test is passed, and the circuit breaker 100 is released to the released ON configuration shown in FIG. 1B, tripping mechanisms including mechanical, electromechanical and material components to accomplish circuit breaker tripping become operative. For example, a mechanical tripping mechanism 134 as shown in FIGS. 1A-1B may each include a cradle 111, spring 110, armature 136, armature spring 137, magnet 138, and bimetal element 140, as is described in US Pub. No. 2010/0238611 entitled "Low-Profile Electronic Circuit Breakers, Breaker Tripping Mechanisms, And Systems and Methods of Using Same," the disclosure of which is hereby incorporated by reference herein in its entirety. The electronic tripping mechanism may include the electronic circuit 118, which may be provided on a printed circuit board, and may include one or more sensors that are adapted to sense various current conditions of the connected electrical circuit branch, as well as one or more actuators. The electronic circuit 118 may process the indicative signal(s) from the sensors. In particular, the electronic circuit 118 may execute an algorithm to determine whether an unwanted electrical condition exists in the protected electrical circuit branch, such as an arc fault (serial or parallel), a ground fault, or other unwanted electrical condition, for example.

In some embodiments, a maglatch 136A on the armature 136 may be activated by a maglatch actuator 142 when certain fault criteria are met. Activating the actuator trips the cradle 111 and therefore trips the circuit breaker 100 to a TRIP configuration separating the main contacts 112 and opening the protected electrical circuit branch. The particular algorithms for determining the existence of an unwanted electrical fault condition, and the electronic circuit components of the electronic circuit 118 will not be further described herein, as they are well known in the art. For example, such circuits and fault detection methods may be found in U.S. Pat. Nos. 5,729,145, 5,946,174, 6,617,858, 6,633,824, 7,368,918, 7,492,163, and 7,864,492, the disclosures of each of which are hereby incorporated by reference herein.

As is best illustrated in FIG. 4B, when the handle 104 is first moved to the unreleased ON configuration, the leaf spring 132 is flexed and the attached moveable secondary electrical contact 121M is urged into direct contact with the stationary secondary contact 1215. This closes the path between the conduit 133 and conduit 134 and provides power to the power supply 123 of the electronic circuit 118 and various electrical components (e.g., the unlock actuator 126 and the maglatch actuator 142).

FIGS. 1B and 4C illustrate the circuit breaker 100 in the released ON configuration. For example, this may be after a self test has been passed. In this configuration, the moveable stop 124 has been retracted by unlock actuator 126 thereby compressing bias spring 128 and releasing the moveable contact arm 108. Once released by the moveable stop 124, the moveable contact arm 108 pivots and moves due to the spring force exerted by spring 110 to the released ON configuration shown. In the released ON configuration, the moveable main electrical contact 112M on the contact arm 108 comes into direct physical and electrical contact with the stationary main electrical contact 112S. This closes the main electrical contacts 112, completes the circuit, and allows power from the power terminal 105 to pass through the main contacts 112 into the contact arm 108 then through the other components in the electrical path and to the load terminal 106.

Figure 5A:
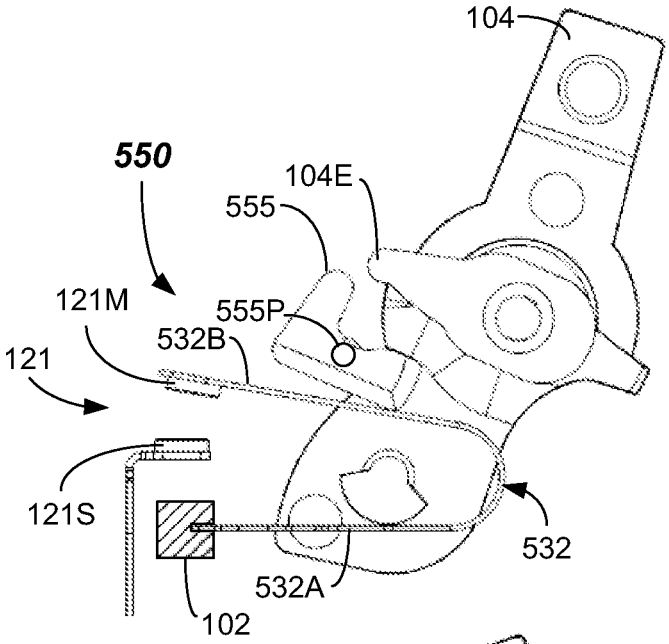
FIGS. 5A and 5B illustrates side views of several components of a circuit breaker in an OFF configuration with the secondary electrical contacts being open, and the ON configuration with the secondary electrical contacts being closed (dotted), respectively.
Figure 5B:
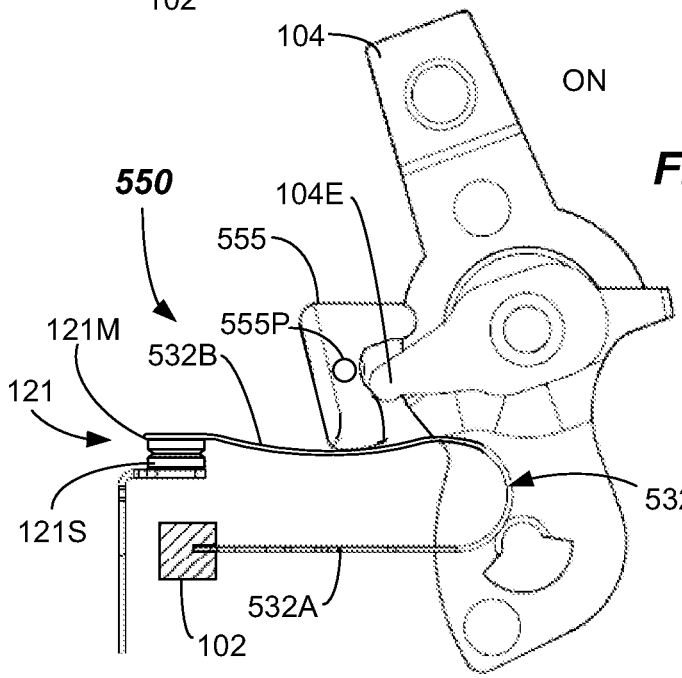

FIGS. 5A and 5B illustrate an alternative embodiment of a circuit breaker with many components not shown for clarity. The other components are the same as in FIGS. 1A-1B. In accordance with another aspect, a secondary contact assembly 550 of the circuit breaker is shown. The secondary contact assembly 550 may function, upon closure of the secondary contacts 121 to power an internal electronic circuit (e.g., electronic circuit 118) or initiate a self test as described herein. The assembly 550 includes a leaf spring 532 that is positioned and functional to be flexed by contact with a cam 555. The leaf spring 532 includes a moveable secondary electrical contact 121M coupled thereto. The depicted leaf spring 532 has a first portion 532A extending in a first direction, and a second portion 532B extending in a second direction different from the first direction. The portions 532A, 532B may be generally straight. The second direction may be generally opposite from the first direction so that the two portions 532A, 532B may at least partially overlap. In the depicted embodiment, the moveable secondary electrical contact 121M is attached to the second portion 532B, such as at an end thereof. In contrast to the previous embodiment, wherein the leaf spring 132 is operatively contacted by the handle 104 such as by a handle extension 104E, in the present embodiment, the leaf spring 132 is operatively contacted by the cam 555. Similarly, the cam 555 is operatively contacted by the handle 104, such as by a handle extension 104E.

As shown in FIG. 5B, as the handle 104 is rotated towards the ON configuration, the handle extension 104E contacts the cam 555 and rotates the cam 555 about a cam pivot 555P. Cam pivot 555P may be formed from one or more projections received in a portion of the housing (not shown), or projections extending from the housing received in a hole formed in the cam 555. Other suitable pivot forming means may be provided, such as step screws or step rivets. Rotation of the cam 555 by handle causes the cam 555 to flex the leaf spring 532 from the original configuration to a flexed condition. This flexing causes the moveable electrical contact 121M to come into contact with the stationary secondary electrical contact 121S. This completes the electrical circuit and may provide, as previously described, power to a power supply (e.g., power supply 123). Because of the relatively long length of the two-portion leaf spring 532, and the use if a cam 555, the spring force against the handle 104 is significantly reduced. Accordingly, the spring force of the leaf spring 132 does not appreciably detract from the spring force provided by the main spring 110. Thus, good contact pressure may be provided between the main electrical contacts 112.

Figure 6:
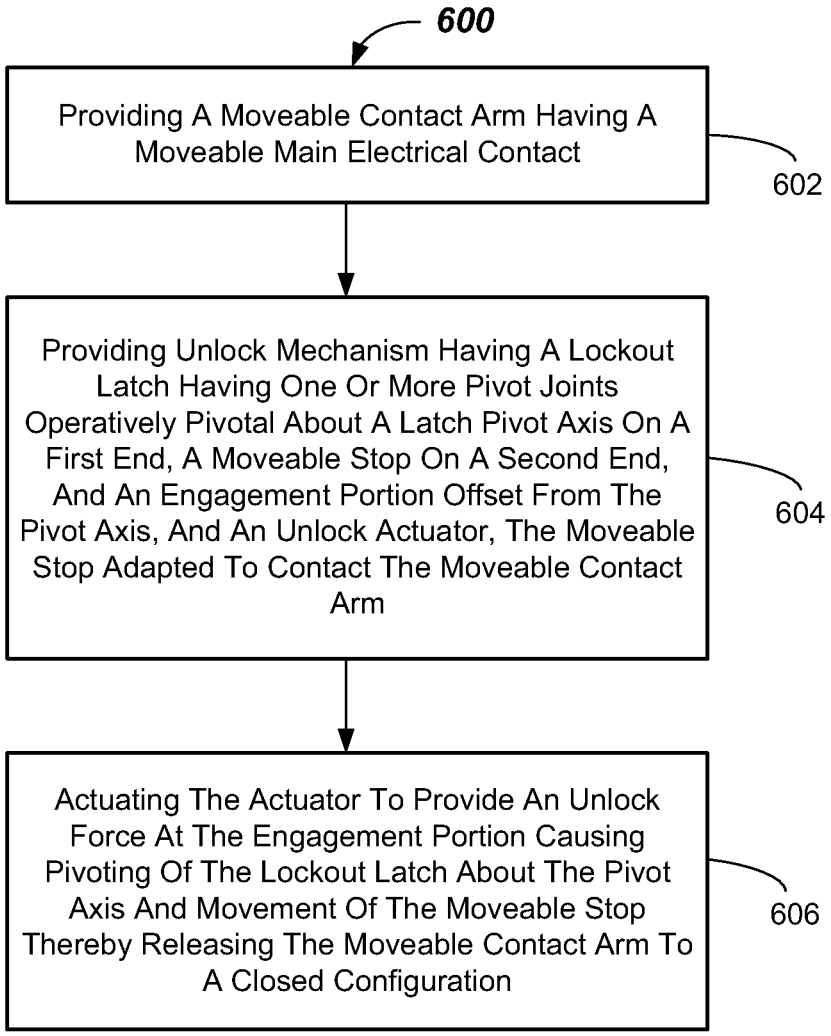
FIG. 6 illustrates a flowchart illustrating a method of operating an electronic circuit breaker according to embodiments.

FIG. 6 is a flowchart illustrating a method of operating an electronic circuit breaker 100 according to another aspect. The method 600 includes providing a moveable contact arm (e.g., contact arm 108) having a moveable main electrical contact (e.g., moveable main contact 112M) in 602. In 604, an unlock mechanism (e.g., lockout mechanism 114) is provided having a lockout latch (e.g., lockout latch 116) having one or more pivot joints (e.g., pivot joints 117A, 117B) operatively pivotal about a latch pivot axis (e.g., axis 117) on a first end, a moveable stop (e.g., moveable stop 124) on a second end, an engagement portion (e.g., engagement portion 120) offset from the pivot axis, and an unlock actuator (e.g., unlock actuator 126), the moveable stop being adapted to contact the moveable contact arm. In 606, the unlock actuator is actuated to provide an unlock force at the engagement portion causing pivoting of the lockout latch about the pivot axis and movement of the moveable stop thereby releasing the moveable contact arm to a closed configuration. Accordingly, this releases the contact arm 108 and under the force of the main spring 110, closes the main contacts 112.

It should now be apparent that utilizing the electronic circuit breaker 100 provides the ability to lock the moveable contact arm 108 when in the ON configuration. The contact arm 108 may be unlocked when a self test is passed, for example. Additionally, efficient unlock mechanisms and secondary contact assemblies are provided.

FIGS. 7A-7K illustrates various views of an electronic circuit breaker subassembly 701 of a circuit breaker 700 and components thereof. The electronic circuit breaker subassembly 701 includes a housing 702 made of an insulating material such as plastic, and has various cavities formed therein to contain and secure various circuit breaker components and subassemblies. Circuit breaker secondary electrical contact assembly 701 includes a main contact terminal 703 connectable to a main power terminal 705, such as by 16 AWG gauge power conductor 742 that may be welded to each component. Main power terminal 705 is adapted to electrically connect to a stab of a panelboard (not shown), for example. The secondary electrical contact assembly 701 further includes a secondary electrical contact set 721 having a stationary secondary electrical contact 721S and a moveable secondary electrical contact 721M. The electrical contacts 721S and 721M may be made of a silver tungsten material, for example. Other suitable materials may be used. A lockout conductor 733 is provided in spring-engaged contact with the main contact terminal 703 on a first end 735 of the lockout conductor 733 and includes one of the stationary or moving secondary electrical contacts 721S, 721M on a second end 739 of the lockout conductor 733. Lockout conductor 733 may be a bent strap of an electrically-conductive material, such as phosphor bronze and may have a thickness of about 0.02 inch (0.51 mm) and a width of about 0.125 inch (3.2 mm), for example. Other dimensions and materials may be used. The spring-engaged contact with the main contact terminal 703 on the first end 735 may be provided by a spring connector 744. Spring connector 744 may be formed as a bent-back tang, which is provided in electrically engaging contact with the main contact terminal 703. A spring engagement contact force of greater than about 2 lb. may be provided. The electronic circuit breaker subassembly 701 also includes a spring 732 having the moveable secondary electrical contact 721M provided on a moveable portion 741 thereof (FIG. 7G), and a handle 704 (FIGS. 7I-7K) moveable between at least an ON configuration and an OFF configuration, the handle 704 configured and operable to cause motion of the moveable portion 741 of the spring 732 and cause engagement of the moveable secondary electrical contact 721M and stationary secondary electrical contact 721S. This provides electrical power to power an internal electronic circuit 718 (shown dotted), which may be provided on a printed circuit board 743, for example.

In the depicted embodiment, the spring 732 may be a leaf spring. As best shown in FIG. 7G, the spring 732 has a first portion 745 that is adapted to be stationarily received in the housing 702, and the moveable portion 741, which may overly (e.g., bent back over) the first portion 745, and may include the moveable secondary electrical contact 721M thereon, such as welded at an end thereof. The spring 732 may be made of a spring material, such as spring tempered steel/stainless steel, brass, or phosphor bronze material, for example, and each portion 741, 745 may have a length of about 0.6 inch (15.2 mm), a width of about 0.15 inch (3.8 mm), and a thickness of about 0.012 inch (0.31 mm). Other sizes may be used. As depicted, the first portion 745 comprises a holding tab 748 adapted to be stationarily inserted into a retaining feature 750 (e.g., a pocket) formed in the housing 702. The retaining feature 750 may have any shape that suitably retains the holding tab 748 of the first portion 745 therein. Holding tab 748 may include a holding barb 752, which may be flexed as the holding tab 748 is inserted into the retaining feature 750 in order to hold the spring 732 securely therein. Additionally, the first portion 745 may include a wire welding tab 754 having a wire 755 secured thereto, such as by braising, welding, or the like. Wire 755 is electrically coupled to the printed circuit board 743 containing an internal electronic circuit and provides electrical power thereto.

Figure 7A:
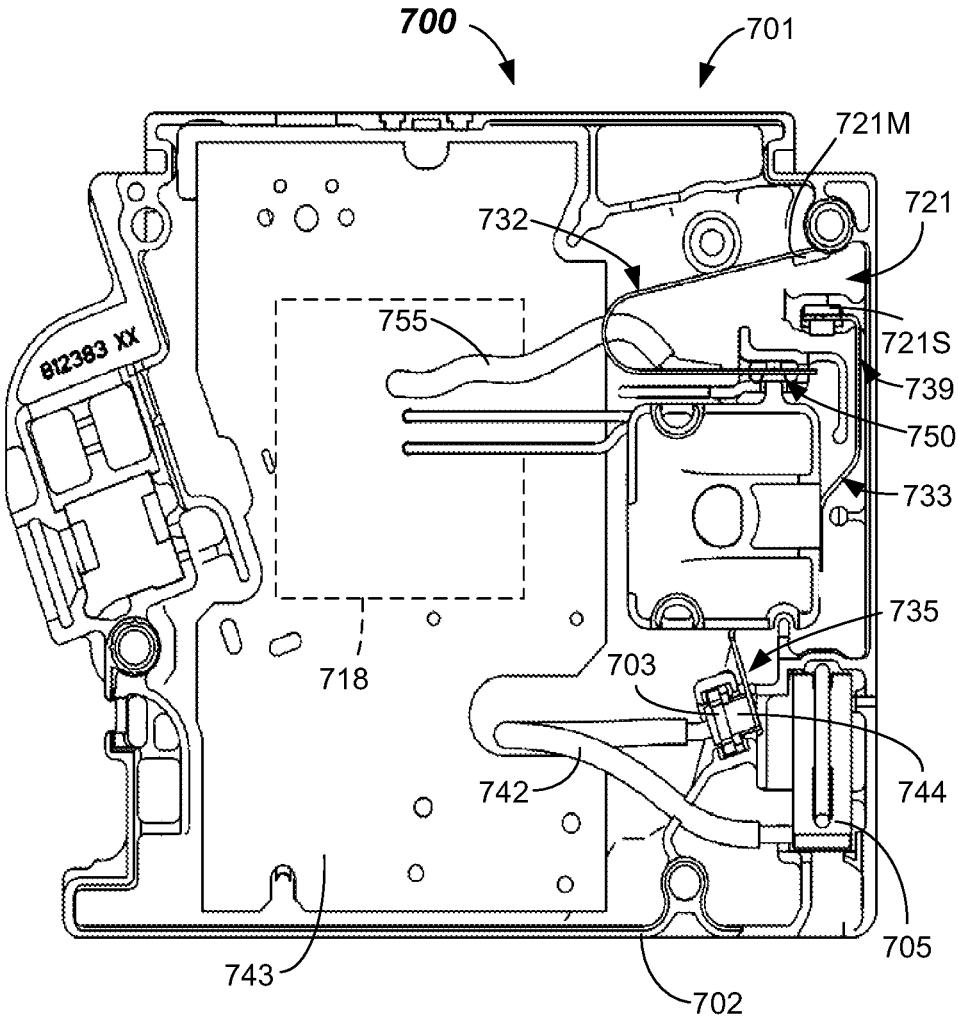
FIG. 7A illustrates a side view of an electronic circuit breaker subassembly according to embodiments.
Figure 7B:
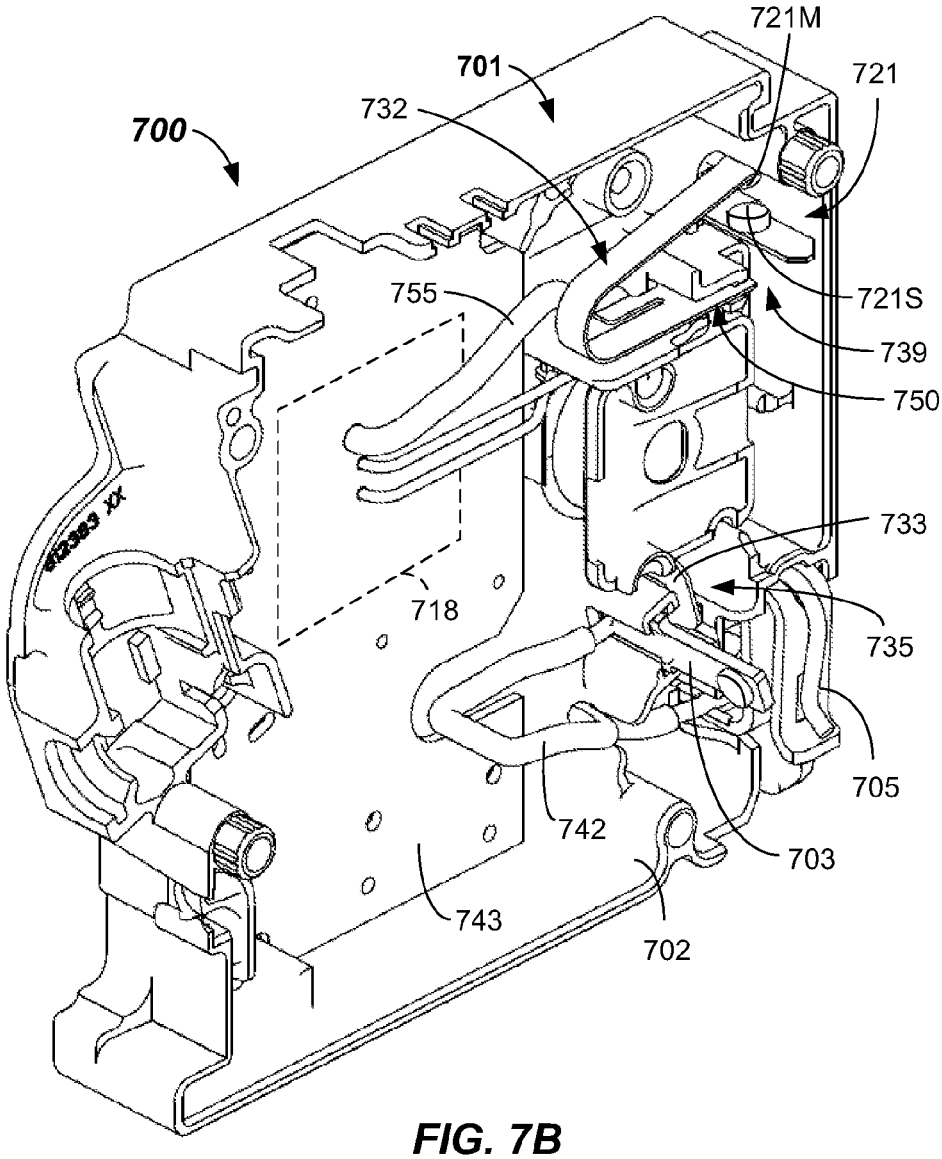
FIG. 7B illustrates an isometric view of an electronic circuit breaker subassembly according to embodiments.
Figure 7C:
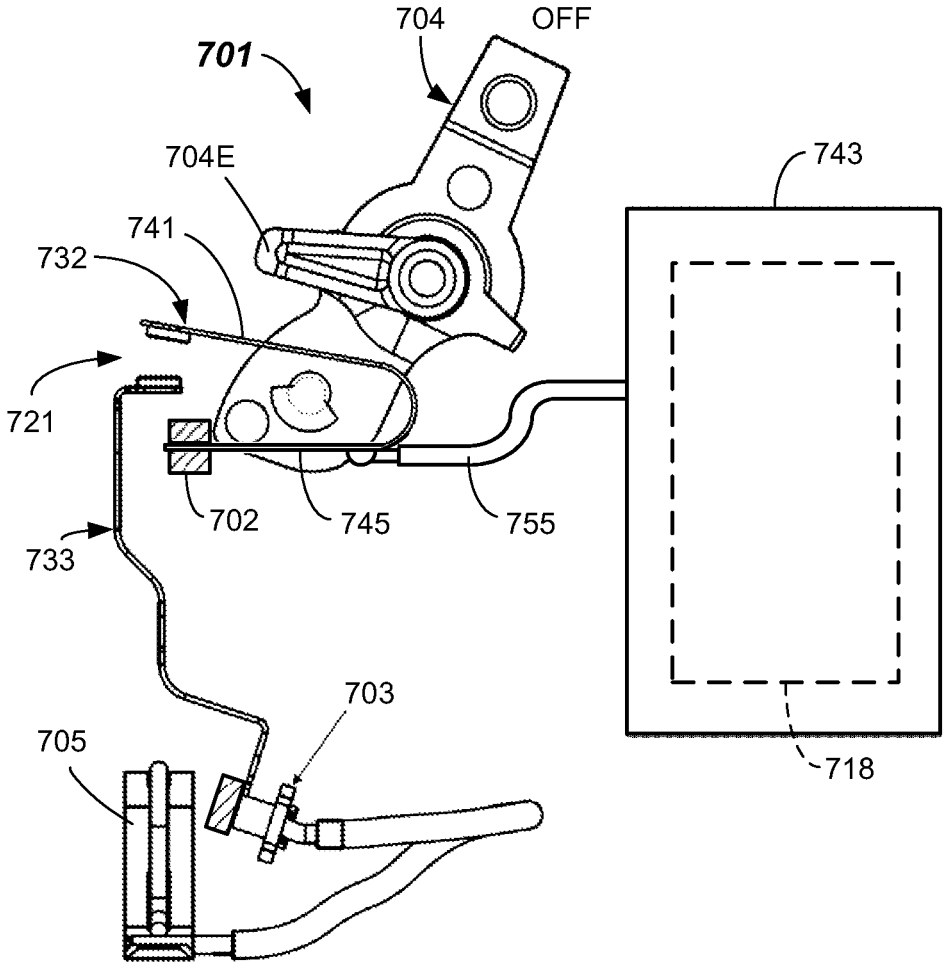
FIG. 7C illustrates a side view of a circuit breaker secondary electrical contact assembly according to embodiments, shown in an OFF configuration.
Figure 7D:
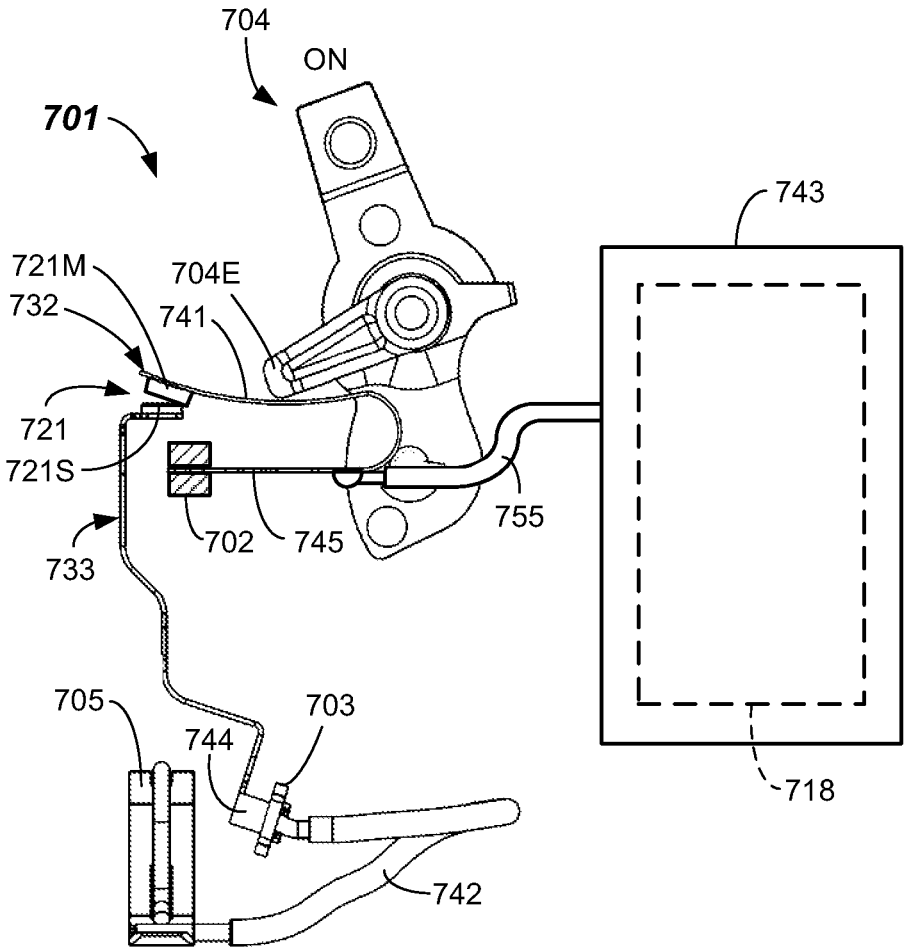
FIG. 7D illustrates a side view of a circuit breaker secondary electrical contact assembly according to embodiments, shown in an ON configuration.
Figure 7E:
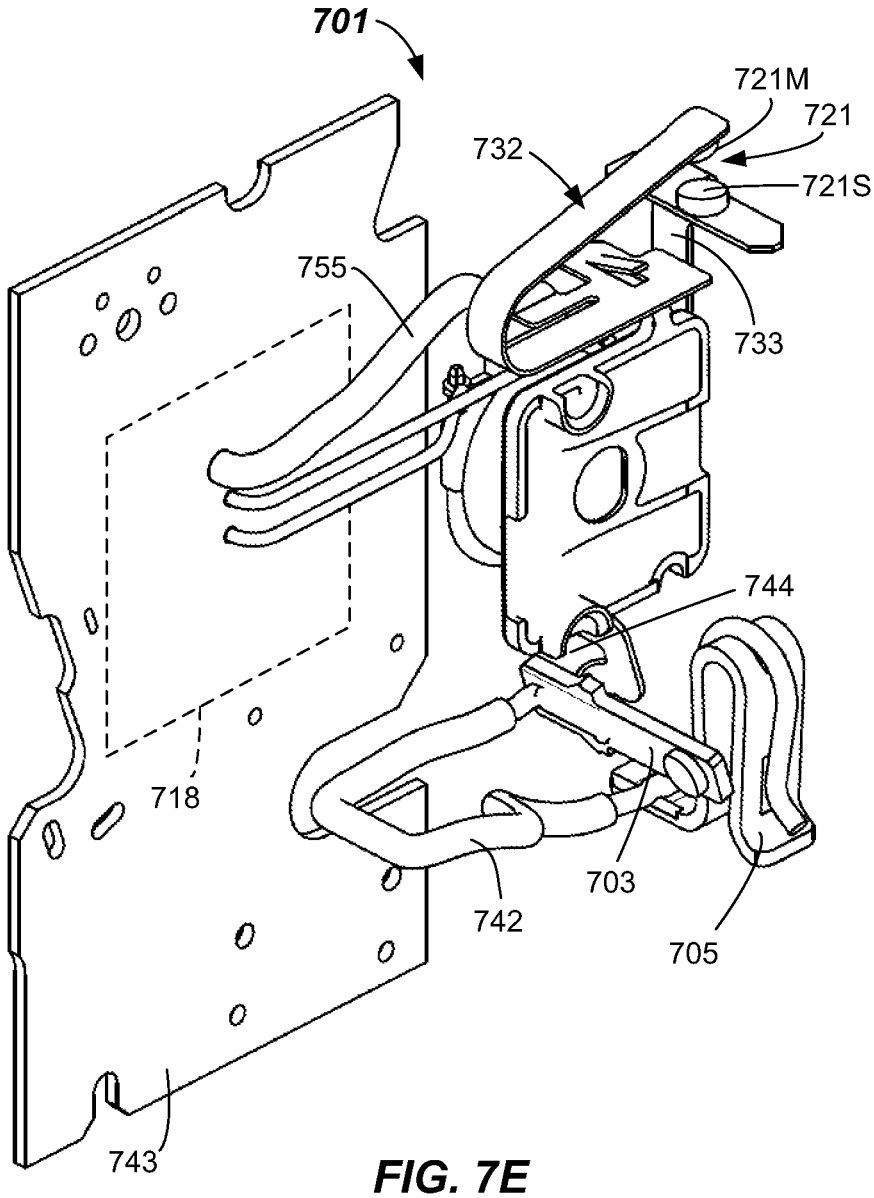
FIGS. 7E and 7F illustrate various isometric views of a circuit breaker secondary electrical contact assembly according to embodiments.
Figure 7F:
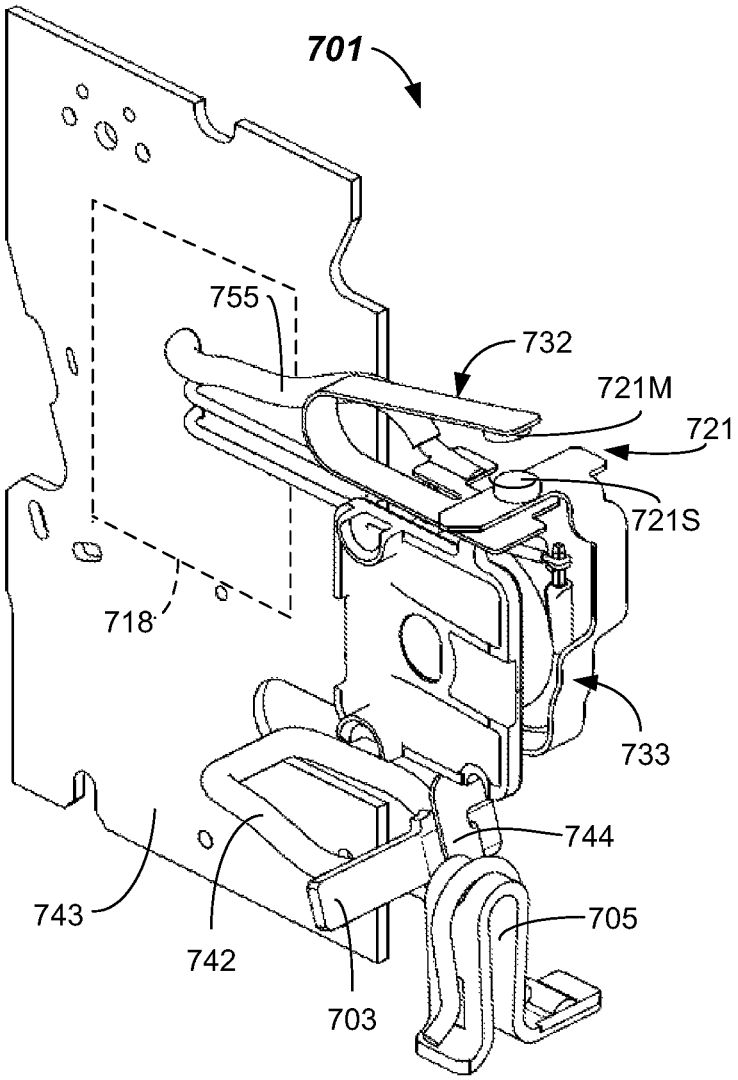
Figure 7G:
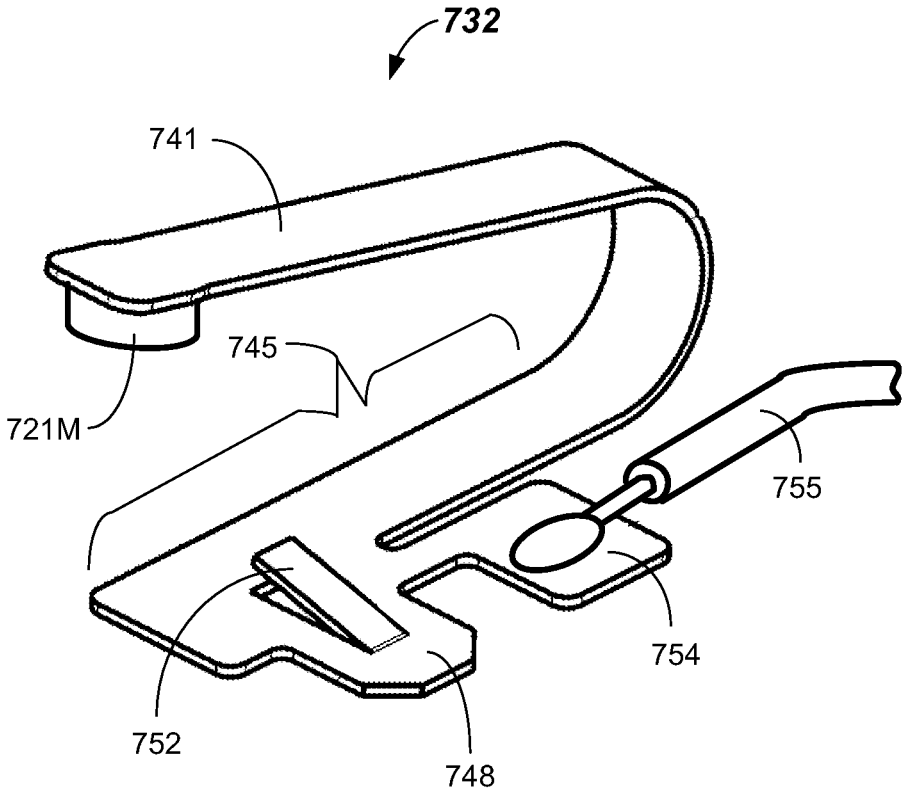
FIG. 7G illustrates an isometric view of a leaf spring according to embodiments.
Figure 7H:
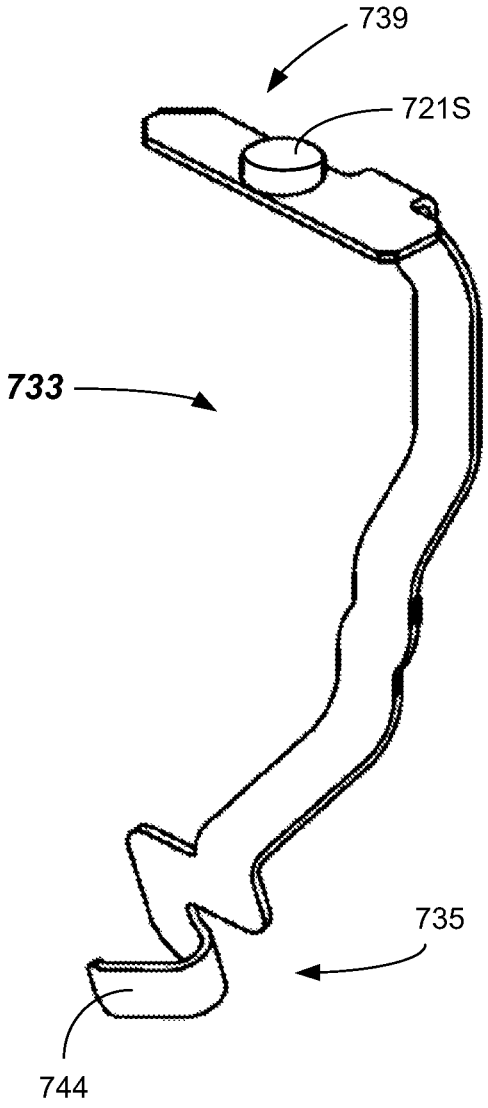
FIG. 7H is an isometric view of a lockout conductor according to embodiments.

As is shown in FIGS. 7C and 7D, the electronic circuit breaker subassembly 701 of the electronic circuit breaker 700 includes a handle 704 and a handle extension 704E configured and operable to contact the spring 732, such as leaf spring shown, when the handle 704 is first thrown to an ON configuration (FIG. 7D) from an OFF configuration (FIG. 7C). As the handle 704 is thrown to the ON configuration, the handle extension 704E directly contacts the moveable spring portion 741 of the spring 732 overlying the first spring portion 745 wherein the first spring portion 745 is retained in a retaining portion of the housing 702. The contact of the handle extension 704E with the spring 732 may be made at about 0.5 inch (12.2 mm) from a rotational axis of the handle 704, for example.

This causes the spring 732 to flex as shown in FIG. 7D thereby causing the secondary contact set 721 to be urged into intimate contact. This causes electrical current to flow from the main power terminal 705 to the main contact terminal 703 through primary power conductor 742, through the lockout conductor 733, through the spring 732 and then through the wire 755 to power the internal electronic circuit 718 (shown dotted) of the PCB 743.

The handle 704, as shown in FIG. 7I-7K may have depending therefrom, the handle extension 704E. Handle extension 704E may include a pilot 704P that is received (e.g., press fit) into a handle recess 704R. The recess 704R and pilot 704P may include a non-circular shape to prevent relative rotation there between. The handle 704 and/or the handle extension 704E may include a bore 704B adapted to receive one or more projections from the housing 702 to form a handle pivot about which the handle 704 may rotate. The internal electronic circuit 718 may be any suitable electronic circuit capable of conducting a self test to determine operability or non-operability of the fault detection electronic circuitry or monitoring electronic circuitry of the electronic circuit breaker. Thus, closing the secondary electrical contact set 721 powers the internal electronic circuit 718 with 120V, for example. Once the circuit breaker 700 passes the self test, the unlock latch 116 is unlatched and the contact arm 108 is allowed to close. The handle extension 704E continues to contact the spring 732 and provide power to the PCB 743.

Figure 7L:
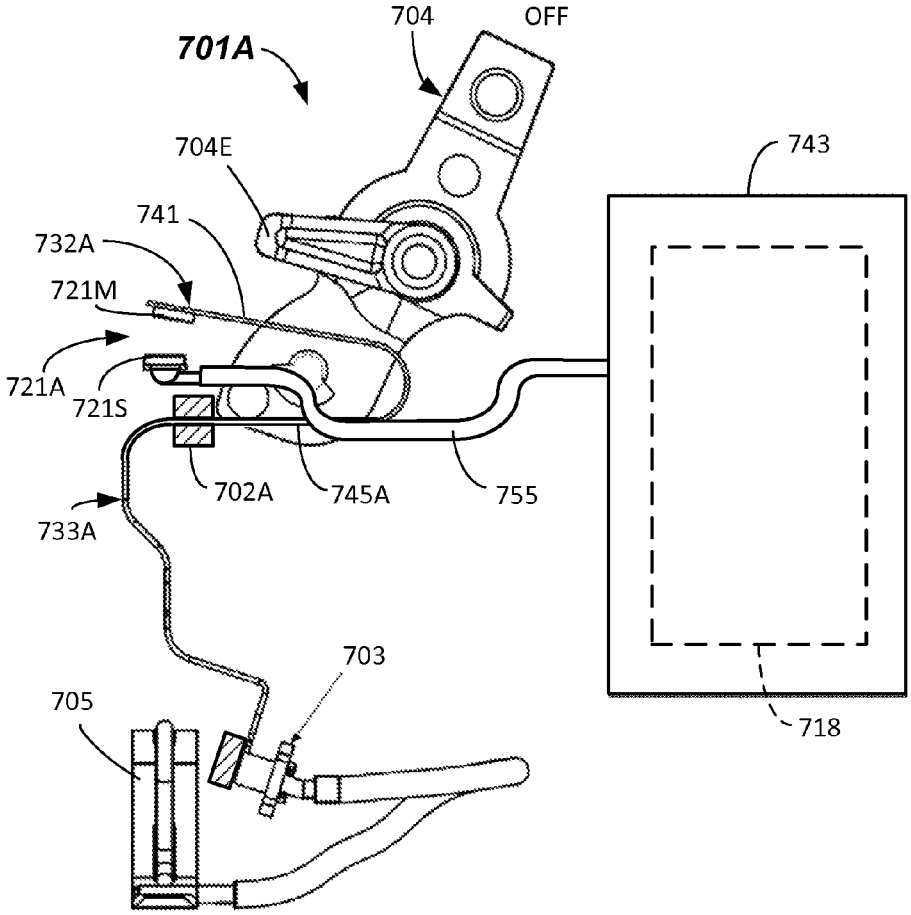
FIG. 7L illustrates a side view of an alternative circuit breaker secondary electrical contact assembly according to embodiments.

FIG. 7L illustrates an alternative construction of an electronic circuit breaker subassembly 701A. In the depicted embodiment, the spring 732A may be a leaf spring, and has a first portion 745A that is adapted to be stationarily received in the housing 702A. As before, the circuit breaker secondary electrical contact assembly 701A includes a main contact terminal 703 connectable to a main power terminal 705. The secondary electrical contact assembly 701A further includes a secondary electrical contact set 721A having a stationary secondary electrical contact 721S and a moveable movable electrical contact 721M. However, in this embodiment, the movable electrical contact 721M is part of the lockout conductor 733A. Otherwise, the secondary electrical contact assembly 701A functions in a same manner as before, being closed by the action of the handle 704 and handle extension 704E.

Figure 8A:
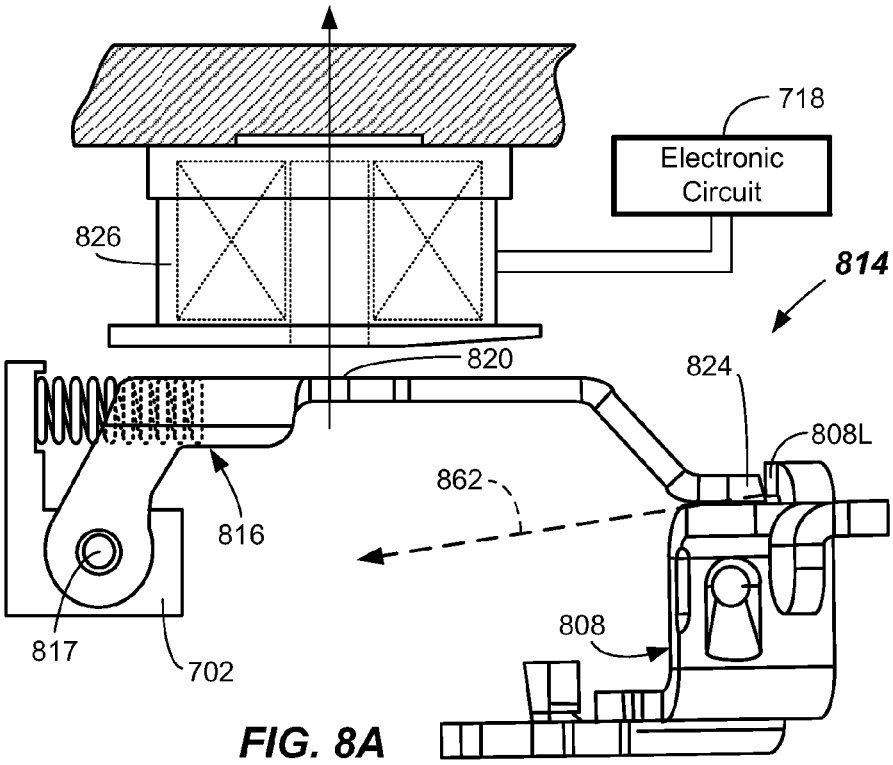
FIGS. 8A-8C illustrates top views of an alternative unlocking mechanism having an angled end latching surface according to embodiments.
Figure 8B:
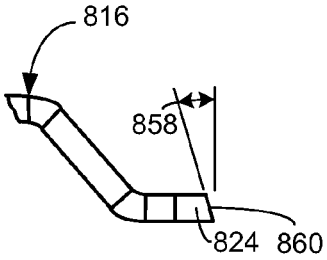
Figure 8C:
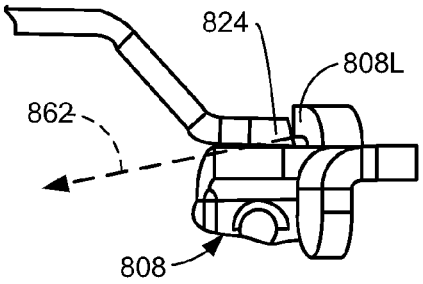

FIGS. 8A-8B illustrates a variation on the construction of the unlock latch 816 of the unlock mechanism 814. In particular, an end latching surface 860 of the moveable stop 824 may be configured to include an angle 858 on the end latching surface 860 (FIG. 8B) that contacts the lock member 808L of the moveable contact arm 808. The angle 858 may be other than 90 degrees (a non-90 degree angle), and may be between about 2 degrees to about 50 degrees in some embodiments, or even between about 2 degrees and 10 degrees in other embodiments. Thus, when end latching surface 860 of moveable stop 824 contacts the lock member 708L, secure latching is provided. The secure latching is provided because a latching force vector 862 (shown dotted as a vector normal to the surface 860) is directed below the location of the pivot axis 817 (e.g., on an opposite side of the pivot axis 817 from the engagement portion 820). This tends to urge or bias the unlock lockout latch 816 to remain closed until a signal may be sent from the internal electronic circuit 818 to the unlock actuator 826 to pivot the unlock latch 816, (similar to that shown in FIG. 3), thereby moving the moveable stop 824 from the lock member 808L and unlocking and releasing the moveable contact arm 808. In other words, because the end latching surface 860 has a non-90 degree angle, it contacts the edge (e.g., corner) of the lock member 708L and thus biases the lockout latch 816 to a blocking condition until the signal is sent from the internal electronic circuit 718 to the unlock actuator 826.

Advantageously, embodiments of the present invention provide the ability to provide a fail-safe feature to the circuit breaker 100, 700 such that the main electrical contacts cannot be closed until a suitable self test of the electronic circuit 118, 718 and/or electrical components is conducted and passed.

The unlock mechanisms 114, 814 described herein provide compact and efficient means to unlock the contact arms 108, 808.

Figure 9:
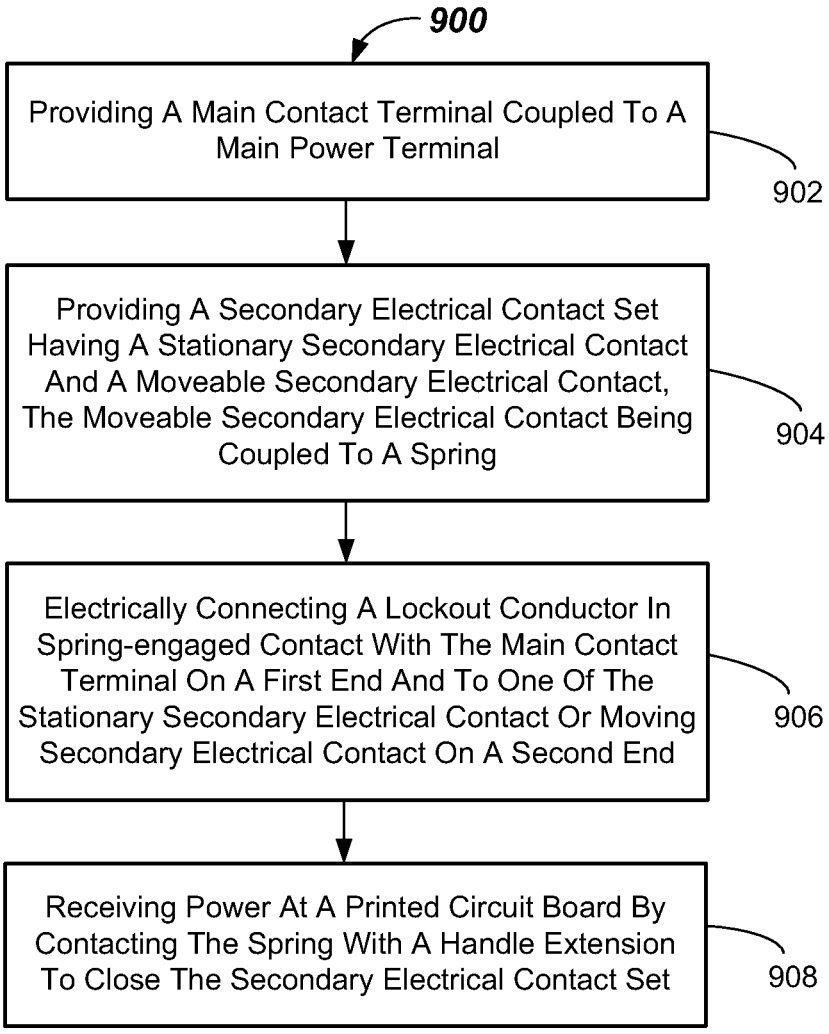
FIG. 9 illustrates a flowchart of a method of powering a printed circuit board of a circuit electronic circuit breaker according to embodiments.

FIG. 9 illustrates a method of powering a printed circuit board of a circuit electronic circuit breaker. The method 900 includes, in 902, providing a main contact terminal (e.g., main contact terminal 703) coupled to a main power terminal (e.g., main power terminal 705), and, in 904, providing a secondary electrical contact set (e.g., secondary electrical contact set 721) having a stationary secondary electrical contact (e.g., stationary secondary electrical contact 721S) and a moveable secondary electrical contact (e.g., moveable secondary electrical contact 721M), the moveable secondary electrical contact being coupled to a spring (e.g., spring 732). The method 900 further includes, in 906, electrically connecting a lockout conductor (e.g., lockout conductor 733) in spring-engaged contact with the main contact terminal on a first end (e.g., first end 735) and to one of the stationary secondary electrical contact or moving secondary electrical contact on a second end (e.g., second end 739). The method 900 further includes, in 908, receiving power at in internal electronic circuit 718 of a printed circuit board (e.g., printed circuit board 743) by contacting the spring with a handle extension (e.g., handle extension 704E) to close the secondary electrical contact set.

While the invention is susceptible to various modifications and alternative forms, specific embodiments and methods thereof are shown by way of example in the drawings and are described in detail herein. It should be understood, however, that the invention is not limited to the particular apparatus, systems, or methods disclosed, but, to the contrary, the intention is to cover all modifications, equivalents, and alternatives falling within the scope of the invention.

What is claimed is:

1. An electronic circuit breaker subassembly, comprising:
a housing;
a main contact terminal connectable to a main power terminal;
a secondary electrical contact set having a stationary secondary electrical contact and a moveable secondary electrical contact;
a lockout conductor provided in spring-engaged contact with the main contact terminal on a first end and including one of the stationary or moving secondary electrical contacts on a second end;
a spring having the moveable secondary electrical contact provided on a moveable portion; and
a handle moveable between at least an ON configuration and an OFF configuration, the handle configured and operable to cause motion of the moveable portion and cause engagement of the moveable secondary electrical contact and stationary secondary electrical contact; wherein:
the main contact terminal, the secondary electrical contact set, the lockout conductor, the spring, and the handle are configured to form a current path to power an electronic circuit capable of performing a self test of an electronic circuit breaker.

2. The electronic circuit breaker of claim 1 wherein the spring comprises a leaf spring.

3. The electronic circuit breaker of claim 2 wherein the handle has a handle extension configured and operable to contact the leaf spring.

4. The electronic circuit breaker of claim 1 wherein the spring comprises a leaf spring comprising:
a first portion stationarily received in the housing, and
a second portion overlying the first portion and including the moveable secondary electrical contact on the moveable portion.

5. The electronic circuit breaker of claim 1 wherein the first end of the lockout conductor provided in spring-engaged contact with the main contact terminal comprises a spring connector.

6. The electronic circuit breaker of claim 1 wherein the main contact terminal includes a holding tab received in a retaining feature formed in the housing.

7. The electronic circuit breaker of claim 1 wherein the main contact terminal includes the stationary electrical contact on a first side and the lockout conductor provided in spring-engaged contact on a second side opposite the first side.

8. An electronic circuit breaker subassembly, comprising:
a housing;
a main contact terminal connectable to a main power terminal;
a secondary electrical contact set having a stationary secondary electrical contact and a moveable secondary electrical contact;
a lockout conductor provided in spring-engaged contact with the main contact terminal on a first end and including one of the stationary or moving secondary electrical contacts on a second end;
a spring having the moveable secondary electrical contact provided on a moveable portion; and
a handle moveable between at least an ON configuration and an OFF configuration, the handle configured and operable to cause motion of the moveable portion and cause engagement of the moveable secondary electrical contact and stationary secondary electrical contact;
wherein the spring comprises a leaf spring comprising:
a first portion stationarily received in the housing, wherein the first portion comprises a holding tab adapted to be stationarily inserted into a retaining feature formed in the housing; and
a second portion overlying the first portion and including the moveable secondary electrical contact on the moveable portion.

9. An electronic circuit breaker subassembly, comprising:
a housing;
a main contact terminal connectable to a main power terminal;
a secondary electrical contact set having a stationary secondary electrical contact and a moveable secondary electrical contact;
a lockout conductor provided in spring-engaged contact with the main contact terminal on a first end and including one of the stationary or moving secondary electrical contacts on a second end;
a spring having the moveable secondary electrical contact provided on a moveable portion; and
a handle moveable between at least an ON configuration and an OFF configuration, the handle configured and operable to cause motion of the moveable portion and cause engagement of the moveable secondary electrical contact and stationary secondary electrical contact;
wherein the spring comprises a leaf spring comprising:
a first portion stationarily received in the housing, wherein the first portion comprises a wire tab having a wire secured to the wire tab, the wire being coupled to a printed circuit board; and
a second portion overlying the first portion and including the moveable secondary electrical contact on the moveable portion.

10. A circuit breaker secondary electrical contact assembly, comprising:
a main contact terminal connectable to a main power terminal;

a secondary electrical contact set having a stationary secondary electrical contact and a moveable secondary electrical contact;

a lockout conductor provided in spring-engaged contact with the main contact terminal on a first end and including one of the stationary or moving secondary electrical contacts on a second end; and a spring having the moveable secondary electrical contact provided on a moveable portion; wherein:

the main contact terminal, the secondary electrical contact set, the lockout conductor, and the spring are configured to form a current path to power an electronic circuit capable of performing a self test of an electronic circuit breaker.

11. The circuit breaker secondary electrical contact assembly of claim 10, wherein the spring comprises a leaf spring.

12. The circuit breaker secondary electrical contact assembly of claim 10 comprising a printed circuit board coupled to receive electrical power through the lockout conductor.

13. The circuit breaker secondary electrical contact assembly of claim 10, wherein the spring comprises a leaf spring having:

a first portion stationarily received in the housing, and a second portion overlying the first portion and including the moveable secondary electrical contact on the moveable portion.

14. A circuit breaker secondary electrical contact assembly, comprising:

a main contact terminal connectable to a main power terminal;

a secondary electrical contact set having a stationary secondary electrical contact and a moveable secondary electrical contact;

a lockout conductor provided in spring-engaged contact with the main contact terminal on a first end and including one of the stationary or moving secondary electrical contacts on a second end; and a spring having the moveable secondary electrical contact provided on a moveable portion;

wherein the spring comprises a leaf spring having:

a first portion stationarily received in a housing, wherein the first portion comprises a holding tab adapted to be stationarily inserted into a retaining feature formed in the housing; and a second portion overlying the first portion and including the moveable secondary electrical contact on the moveable portion.

15. A circuit breaker secondary electrical contact assembly, comprising:

a main contact terminal connectable to a main power terminal;

a secondary electrical contact set having a stationary secondary electrical contact and a moveable secondary electrical contact;

a lockout conductor provided in spring-engaged contact with the main contact terminal on a first end and including one of the stationary or moving secondary electrical contacts on a second end; and a spring having the moveable secondary electrical contact provided on a moveable portion;

wherein the spring comprises a leaf spring having:

a first portion stationarily received in a housing, wherein the first portion comprises a wire tab having a wire secured to the wire tab, the wire being coupled to a printed circuit board; and a second portion overlying the first portion and including the moveable secondary electrical contact on the moveable portion.

16. A method of powering a printed circuit board of a circuit electronic circuit breaker, comprising:

providing a main contact terminal coupled to a main power terminal;

providing a secondary electrical contact set having a stationary secondary electrical contact and a moveable secondary electrical contact, the moveable secondary electrical contact being coupled to a spring;

electrically connecting a lockout conductor in spring-engaged contact with the main contact terminal on a first end and to one of the stationary secondary electrical contact or moving secondary electrical contact on a second end; and receiving power at a printed circuit board by contacting the spring with a handle extension to close the secondary electrical contact set, the printed circuit board comprising an electronic circuit capable of performing a self test of the circuit electronic circuit breaker.

* * * * *